US008269473B2

(12) United States Patent
Noda

(10) Patent No.: US 8,269,473 B2
(45) Date of Patent: Sep. 18, 2012

(54) AC HIGH VOLTAGE POWER SUPPLY DEVICE, CHARGING DEVICE, DEVELOPING DEVICE, AND IMAGE FORMING APPARATUS

(75) Inventor: Hiroo Noda, Saga (JP)

(73) Assignee: Ricoh Company, Ltd., Tokyo (JP)

( * ) Notice: Subject to any disclaimer, the term of this patent is extended or adjusted under 35 U.S.C. 154(b) by 172 days.

(21) Appl. No.: 12/273,077

(22) Filed: Nov. 18, 2008

(65) Prior Publication Data

US 2009/0128103 A1 May 21, 2009

(30) Foreign Application Priority Data

Nov. 19, 2007 (JP) ..... 2007-298839

(51) Int. Cl.
*G05F 1/00* (2006.01)
*G03G 15/02* (2006.01)

(52) U.S. Cl. ..... 323/284; 399/168

(58) Field of Classification Search ..... 323/282, 323/284–286; 399/168; 363/78, 84, 123–125
See application file for complete search history.

(56) References Cited

U.S. PATENT DOCUMENTS

| | | | | |
|---|---|---|---|---|
| 5,930,131 | A * | 7/1999 | Feng | 363/56.03 |
| 6,751,427 | B2 * | 6/2004 | Sugiura | 399/100 |
| 6,785,494 | B2 * | 8/2004 | Yamanoi et al. | 399/174 |
| 7,466,565 | B2 * | 12/2008 | Tanaka | 363/16 |
| 2001/0043817 | A1 * | 11/2001 | Maebashi | 399/50 |
| 2002/0191418 | A1 * | 12/2002 | Clayton et al. | 363/17 |
| 2006/0222406 | A1 * | 10/2006 | Facci | 399/168 |
| 2006/0256589 | A1 * | 11/2006 | Choi | 363/56.04 |
| 2007/0025768 | A1 * | 2/2007 | Komatsu et al. | 399/167 |
| 2007/0139974 | A1 * | 6/2007 | Aikawa et al. | 363/16 |

FOREIGN PATENT DOCUMENTS

| | | | |
|---|---|---|---|
| JP | 04-304170 | | 10/1992 |
| JP | 06-308806 | | 11/1994 |
| JP | 07-241083 | | 9/1995 |
| JP | 09-325655 | | 12/1997 |
| JP | 2001-117325 | | 4/2001 |
| JP | 2001-312123 | | 11/2001 |
| JP | 2001312123 | A * | 11/2001 |
| JP | 2003-333858 | | 11/2003 |
| JP | 2006-80629 | | 3/2006 |
| JP | 2007-171936 | | 7/2007 |
| JP | 2007-199377 | | 8/2007 |

* cited by examiner

*Primary Examiner* — Adolf Berhane
*Assistant Examiner* — Jeffrey Gblende
(74) *Attorney, Agent, or Firm* — Oblon, Spivak, McClelland, Maier & Neustadt, L.L.P.

(57) ABSTRACT

An AC high voltage power supply device includes a comparison circuit configured to compare a first signal of a sinusoidal waveform and a second signal of a triangular waveform; a switching amplifier circuit configured to perform a switching operation based on a comparison result signal output from the comparison circuit to perform signal amplification; a conversion circuit configured to convert a waveform of a switch signal output from the switching amplifier circuit into a sinusoidal waveform; a transformer configured to boost a voltage of a converted signal output from the conversion circuit; and a control circuit configured to perform feedback control on the first signal input to the comparison circuit based on a monitoring signal including an input signal or an output signal of the transformer, so that a peak level of the output signal of the transformer becomes a desired peak level.

10 Claims, 21 Drawing Sheets

AC HIGH VOLTAGE POWER SUPPLY DEVICE, CHARGING DEVICE, DEVELOPING DEVICE, AND IMAGE FORMING APPARATUS

BACKGROUND OF THE INVENTION

1. Field of the Invention

The present invention relates to AC high voltage power supply devices, charging devices, developing devices, and image forming apparatuses, and more particularly to an AC high voltage power supply device for generating an AC high voltage, a charging device and a developing device including the AC high voltage power supply device, and an image forming apparatus including at least one of the charging device and the developing device.

2. Description of the Related Art

A method typically performed by an image forming apparatus such as a printer, fax machine, a copier, or a multifunction peripheral including these functions, includes the steps of charging a photoconductive drum with the use of a charging device, and scanning the surface of the charged photoconductive drum with laser light modulated in accordance with image information to form an electrostatic latent image on the surface of the photoconductive drum.

Furthermore, with the use of a developing device, toner is caused to adhere to the electrostatic latent image formed on the surface of the photoconductive drum to form a visible image (develop the latent image), which is transferred onto a recording sheet.

The above described charging and developing operations typically use a voltage obtained by superposing an AC high voltage and a DC high voltage. Thus, an image forming apparatus typically includes an AC high voltage power supply device for generating an AC high voltage (for example, see patent documents 1 through 4).

Patent Document 1: Japanese Laid-Open Patent Application No. 2001-117325

Patent Document 2: Japanese Laid-Open Patent Application No. 2001-312123

Patent Document 3: Japanese Laid-Open Patent Application No. 2007-171936

Patent Document 4: Japanese Laid-Open Patent Application No. 2007-199377

However, in conventional AC high voltage power supply devices, large power loss is caused by heat generated in the amplifier circuit, which leads to increased power consumption. Furthermore, a large radiator plate is necessary for mitigating temperature increases, and therefore it is difficult to reduce the size of the device.

SUMMARY OF THE INVENTION

The present invention provides an AC high voltage power supply device, a charging device, a developing device, and an image forming apparatus in which one or more of the above-described disadvantages are eliminated.

A preferred embodiment of the present invention provides an AC high voltage power supply device, a charging device, a developing device, and an image forming apparatus in which the size of the device and power consumption can be reduced.

According to an aspect of the present invention, there is provided an AC high voltage power supply device including a comparison circuit configured to compare a first signal of a sinusoidal waveform and a second signal of a triangular waveform, and to output a comparison result signal corresponding to results of the comparison; a switching amplifier circuit configured to perform a switching operation based on the comparison result signal output from the comparison circuit to perform signal amplification, and to output a switch signal; a conversion circuit configured to convert a waveform of the switch signal output from the switching amplifier circuit into a sinusoidal waveform, and to output a converted signal; a transformer configured to boost a voltage of the converted signal output from the conversion circuit; and a control circuit configured to perform feedback control on the first signal input to the comparison circuit based on a monitoring signal including an input signal or an output signal of the transformer, so that a peak level of the output signal of the transformer becomes a desired peak level.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of an embodiment of the present invention.

First Embodiment

Figure 1:
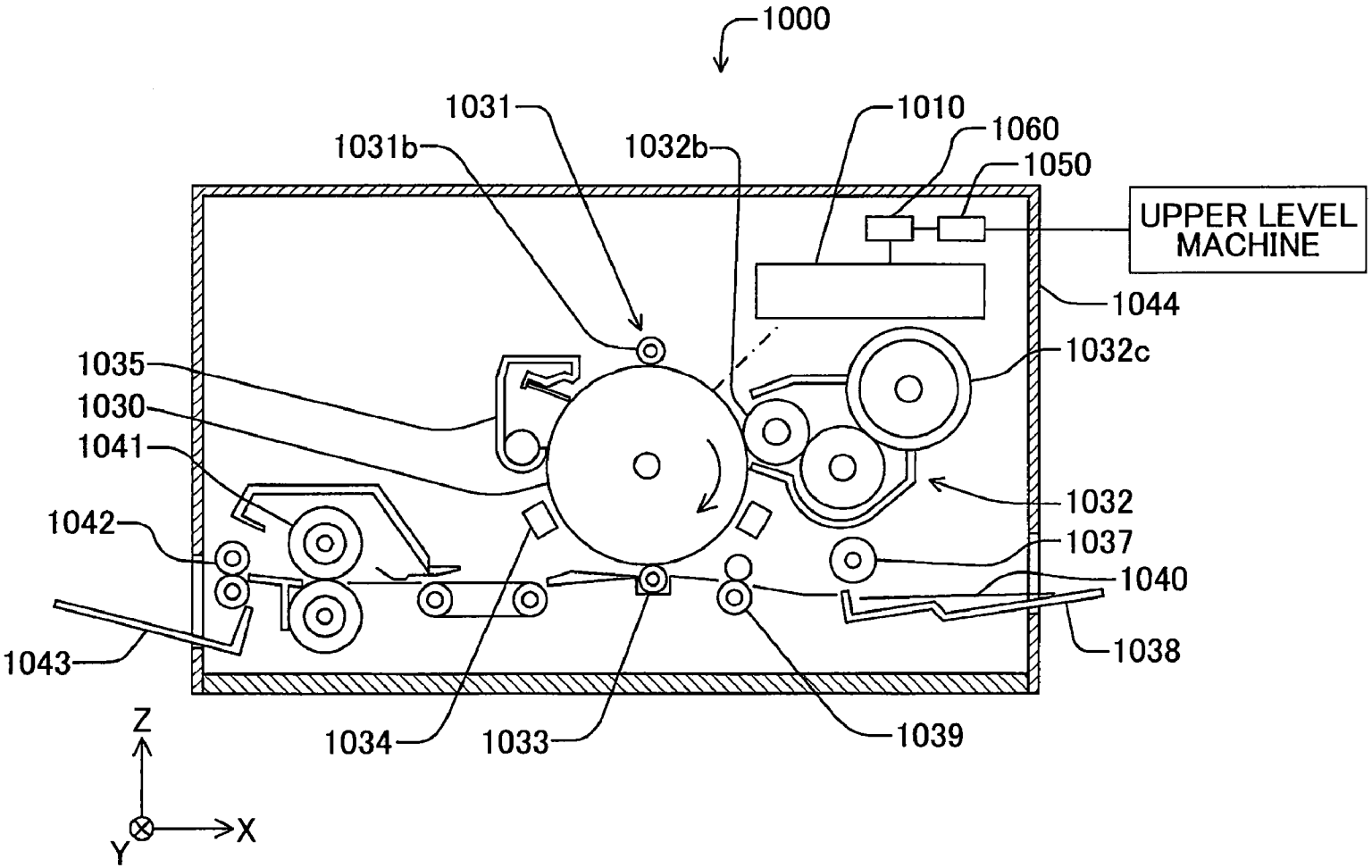
FIG. 1 is a schematic diagram of a laser printer according to a first embodiment of the present invention.

A description is given of a first embodiment according to the present invention with reference to FIGS. 1 through 24. FIG. 1 is a schematic diagram of a laser printer 1000, which is an image forming apparatus according to the first embodiment of the present invention.

The laser printer 1000 includes a light scanning device 1010, a photoconductive drum 1030, a charging device 1031, a developing device 1032, a transfer device 1033, a discharging unit 1034, a cleaning unit 1035, a sheet feeding roller 1037, a sheet feeding tray 1038, a pair of resist rollers 1039, fixing rollers 1041, sheet eject rollers 1042, a sheet eject tray 1043, a communication control device 1050, and a printer control device 1060 which controls all of these units. These units are accommodated in a printer casing 1044 at predetermined positions.

The communication control device 1050 controls bidirectional communication with an upper level machine (such as a personal computer) via a network.

The photoconductive drum 1030 is a cylindrical member having a photoconductive layer formed on its surface. Thus, the surface of the photoconductive drum 1030 is the scanning target surface. The photoconductive drum 1030 is configured to rotate in the direction indicated by the arrow in FIG. 1.

The charging device 1031, the developing device 1032, the transfer device 1033, the discharging unit 1034, and the cleaning unit 1035 are arranged around the surface of the photoconductive drum 1030. These units are provided along the rotational direction of the photoconductive drum 1030 in the order of the charging device 1031→the developing device 1032→the transfer device 1033→the discharging unit 1034→the cleaning unit 1035.

The charging device 1031 uniformly charges the surface of the photoconductive drum 1030. The configuration of the charging device 1031 is described below.

The light scanning device 1010 scans the surface of the photoconductive drum 1030 charged by the charging device 1031 with a light beam modulated in accordance with image information received from an upper level device. Accordingly, an electrostatic latent image corresponding to the image information is formed on the surface of the photoconductive drum 1030. The formed electrostatic latent image moves toward the developing device 1032 as the photoconductive drum 1030 rotates.

The developing device 1032 develops the electrostatic latent image by causing toner to adhere to the electrostatic latent image formed on the photoconductive drum 1030. The image to which the toner has adhered (hereinafter, also referred to as a "toner image" as a matter of convenience), moves toward the transfer device 1033 as the photoconductive drum 1030 rotates. The configuration of the developing device 1032 is described below.

The sheet feeding tray 1038 stores recording sheets 1040. The sheet feeding roller 1037 is arranged near this sheet feeding tray 1038. The sheet feeding roller 1037 extracts the recording sheets 1040 from the sheet feeding tray 1038, one sheet at a time, and conveys them to the pair of resist rollers 1039. The pair of resist rollers 1039 temporarily holds the recording sheet 1040 that has been extracted by the sheet feeding roller 1037, and then sends the recording sheet 1040 to the gap between the photoconductive drum 1030 and the transfer device 1033 in accordance with the rotation of the photoconductive drum 1030.

The transfer device 1033 is applied with a voltage having a polarity opposite to that of toner, in order to electrically attract the toner on the surface of the photoconductive drum 1030 to the recording sheet 1040. Due to this voltage, the toner image on the surface of the photoconductive drum 1030 is transferred onto the recording sheet 1040. The recording sheet 1040 onto which the toner has been transferred is then sent to the fixing rollers 1041.

The fixing rollers 1041 apply heat and pressure to the recording sheet 1040, so that the toner is fixed on the recording sheet 1040. The recording sheet 1040 onto which the toner is fixed is sent to the sheet eject tray 1043 via the sheet eject rollers 1042. The recording sheets 1040 are sequentially stacked on the sheet eject tray 1043.

The discharging unit 1034 discharges the surface of the photoconductive drum 1030.

The cleaning unit 1035 removes the toner (residual toner) remaining on the surface of the photoconductive drum 1030. The portion on the surface of the photoconductive drum 1030 from which the residual toner has been removed returns to the position facing the charging device 1031 once again.

"Charging Device"

Next, a description is given of the configuration of the charging device 1031.

Figure 2:
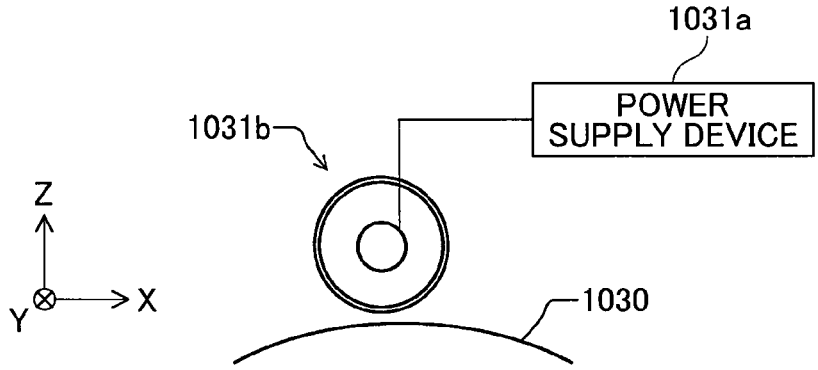
FIG. 2 illustrates a charging device shown in FIG. 1.

As shown in the example of FIG. 2, the charging device 1031 includes a power supply device 1031*a* and a charging roller 1031*b*. In this case, it is assumed that a proximity charging method is performed to charge the photoconductive drum 1030. The photoconductive drum 1030 may be charged by a contact charging method.

Figure 3:
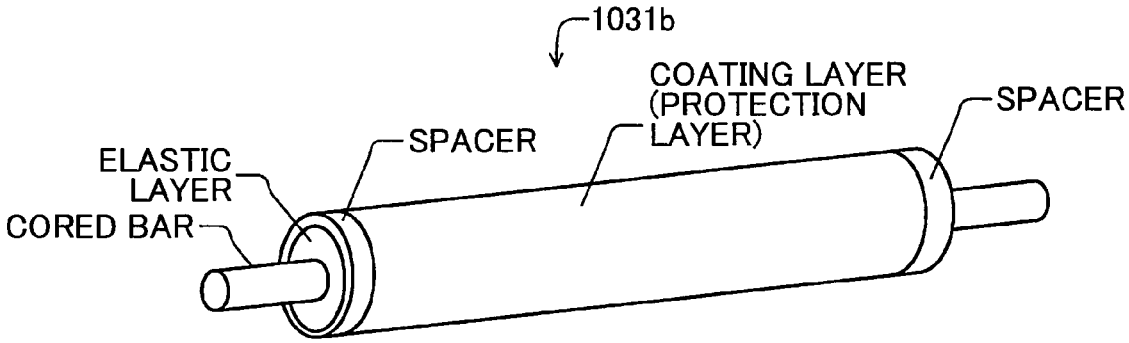
FIG. 3 illustrates a charging roller shown in FIG. 2.

As shown in the example of FIG. 3, the charging roller 1031*b* includes a stick-like cored bar, a cylindrical elastic layer having a mid-level resistance wrapped around the cored bar, and a coating layer (protection layer) coating the periphery of the elastic layer for enhancing abrasion resistance and preventing foreign matter from adhering to the charging roller 1031*b*. Furthermore, spacers are provided so as not to charge the portions of the photoconductive drum 1030 that do not need to be charged (portions where images are not formed). The spacers may be provided on the photoconductive drum 1030 instead of on the charging roller 1031*b*. A spacer can be provided by disposing a sheet-like member such as belt between the charging roller 1031*b* and the photoconductive drum 1030.

Figure 4:
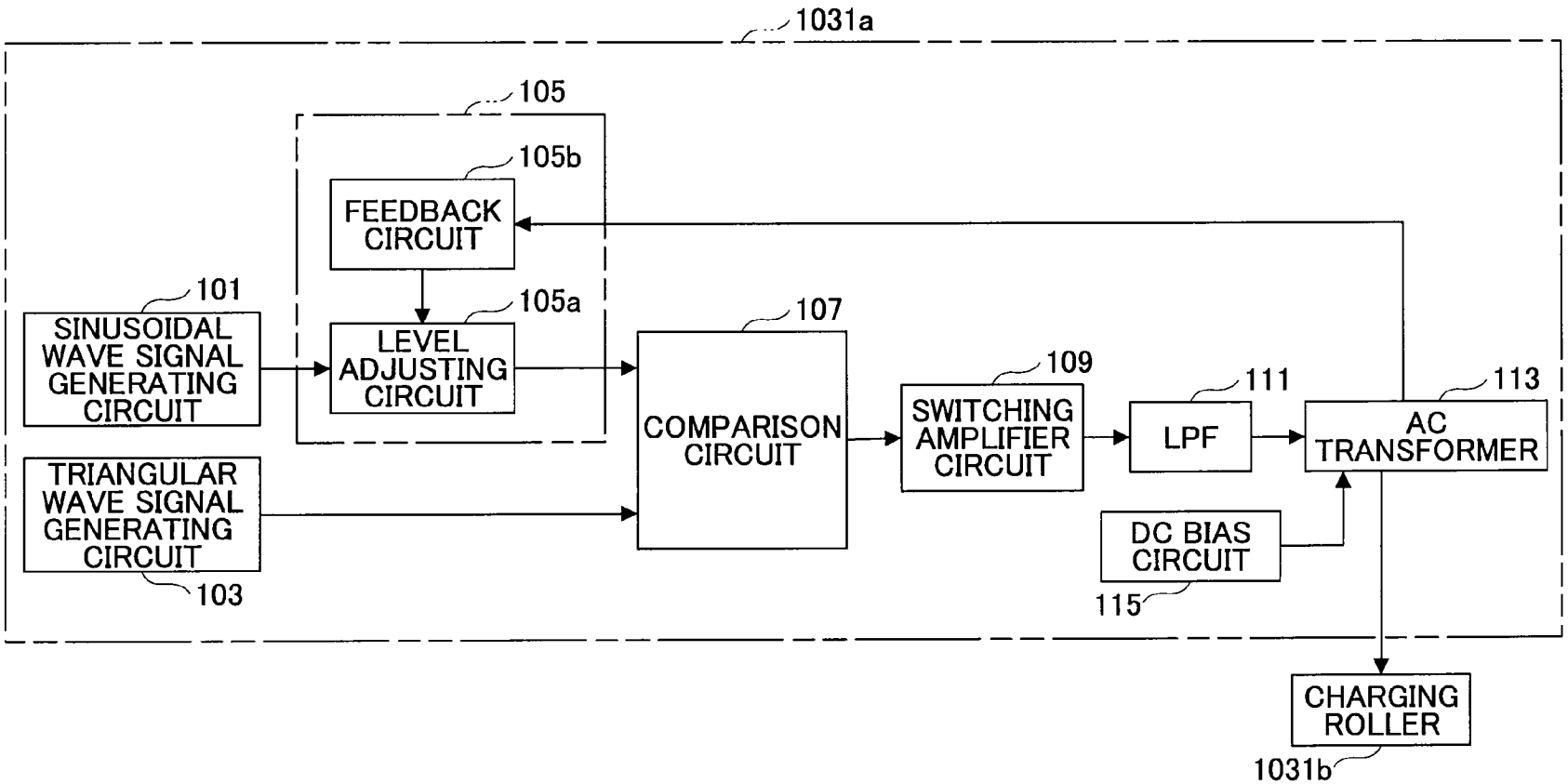
FIG. 4 is a block diagram of a power supply device shown in FIG. 2.

As shown in the example of FIG. 4, the power supply device 1031*a* includes a sinusoidal wave signal generating circuit 101, a triangular wave signal generating circuit 103, a control circuit 105, a comparison circuit 107, a switching amplifier circuit 109, a low-pass filter (LPF) 111, an AC transformer 113, and a DC bias circuit 115.

Figure 5:
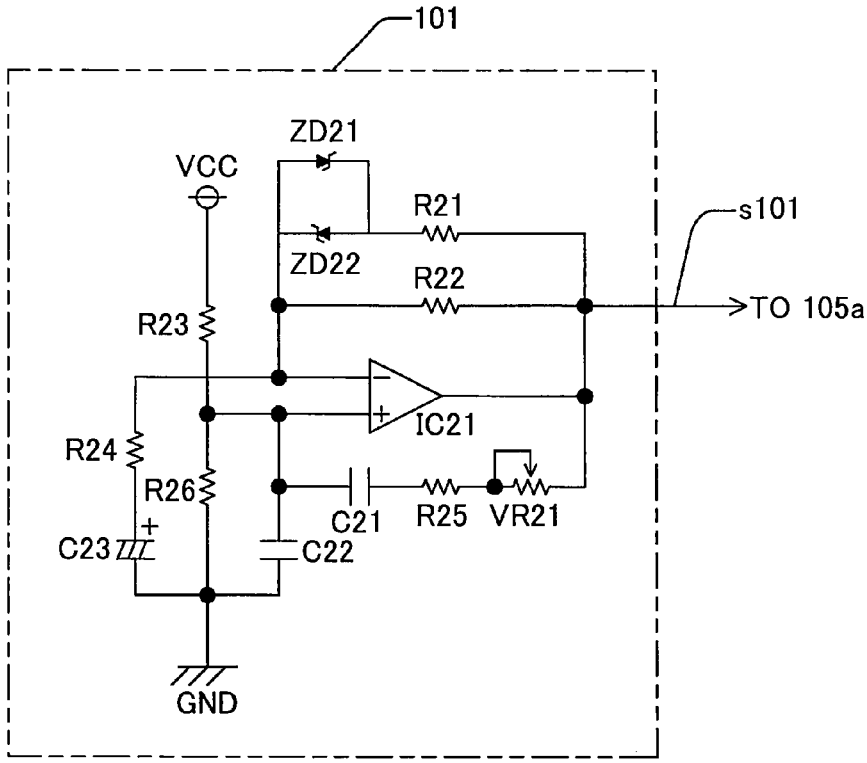
FIG. 5 is a circuit diagram of a sinusoidal wave signal generating circuit shown in FIG. 4.
Figure 6:
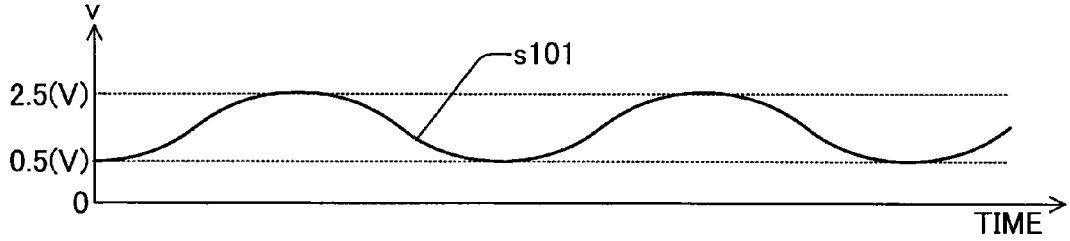
FIG. 6 is a voltage waveform diagram for describing signals output from the sinusoidal wave signal generating circuit shown in FIG. 5.

The sinusoidal wave signal generating circuit 101 generates signals having a sinusoidal waveform of a predetermined frequency (hereinafter, also referred to as "sinusoidal wave signal" as a matter of convenience). As shown in the example of FIG. 5, the sinusoidal wave signal generating circuit 101 includes plural resistors (R21 through R26 and VR21), plural capacitors (C21, C22, C23), plural Zener diodes (ZD21, ZD22), and an operational amplifier IC21. FIG. 6 illustrates an example of a voltage waveform of sinusoidal wave signals s101 output from the sinusoidal wave signal generating circuit 101.

Figure 7:
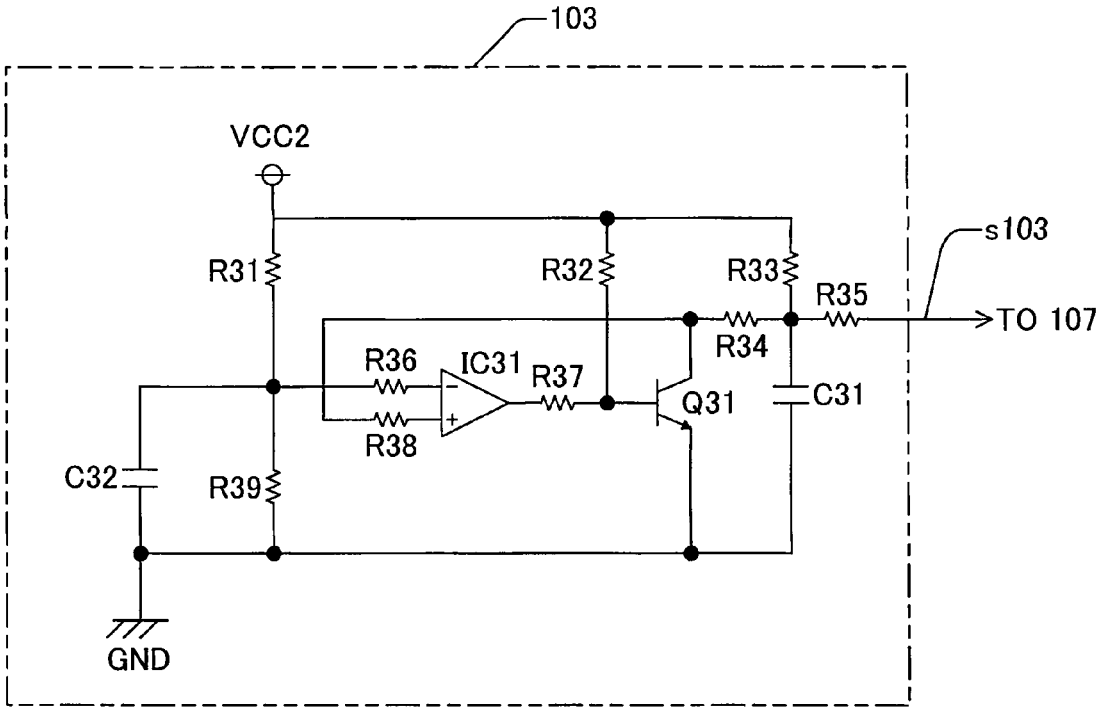
FIG. 7 is a circuit diagram of a triangular wave signal generating circuit shown in FIG. 4.
Figure 8:
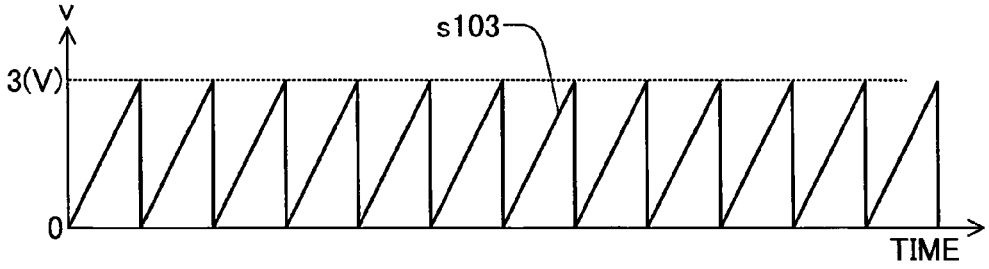
FIG. 8 is a voltage waveform diagram for describing signals output from the triangular wave signal generating circuit shown in FIG. 7.

The triangular wave signal generating circuit 103 generates signals having a triangular waveform (hereinafter, also referred to as "triangular wave signal" as a matter of convenience). As shown in the example of FIG. 7, the triangular wave signal generating circuit 103 includes plural resistors (R31 through R39), plural capacitors (C31, C32), a transistor Q31, and an operational amplifier IC31. FIG. 8 illustrates an example of a voltage waveform of triangular wave signals s103 output from the triangular wave signal generating circuit 103. The waveform of the triangular wave signals (peak value, frequency, etc.) is set in accordance with the waveform of the sinusoidal wave signals (peak value, frequency, etc.).

Figure 9:
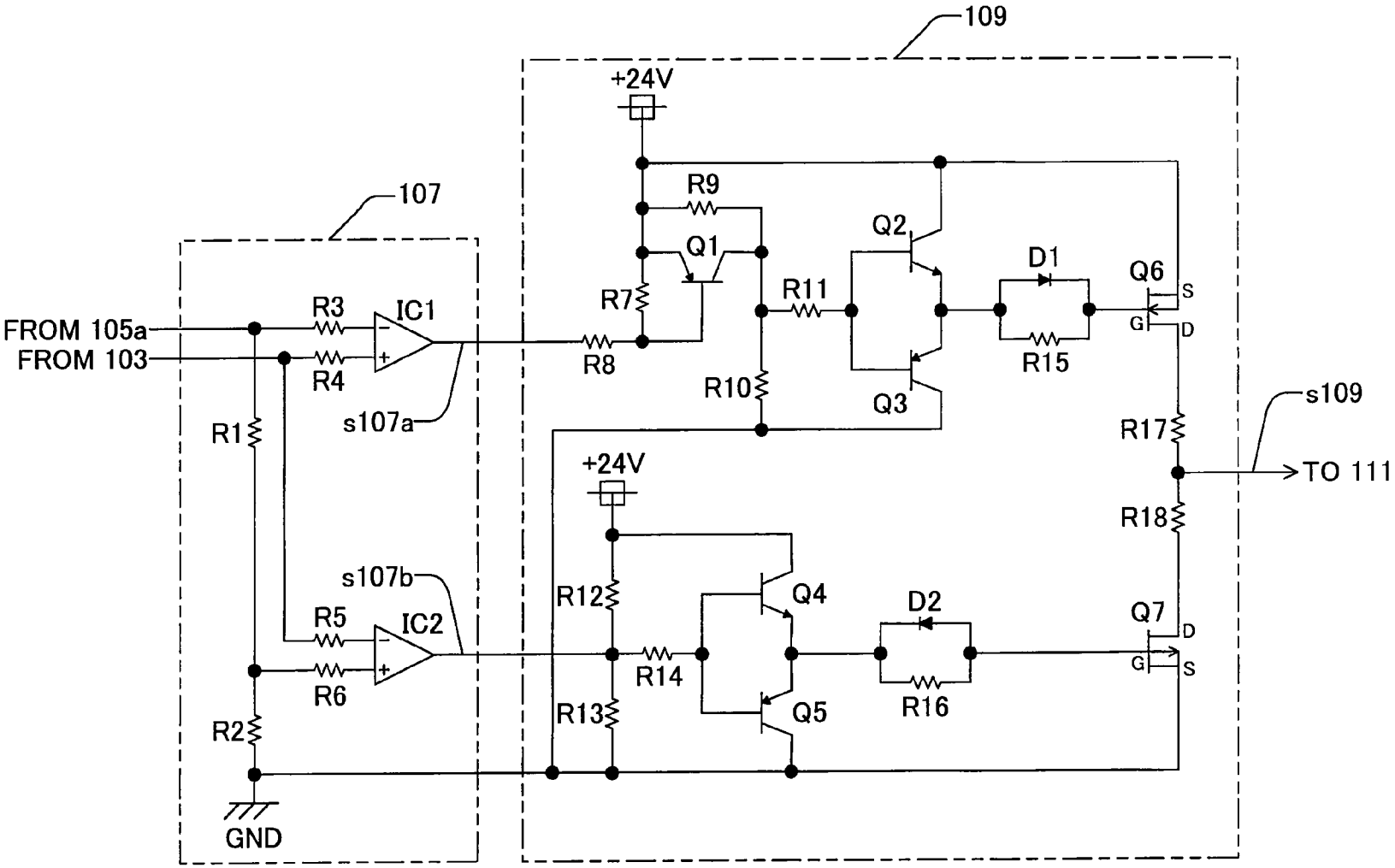
FIG. 9 is a circuit diagram of a comparison circuit and a switching amplifier circuit shown in FIG. 2.
Figure 10:
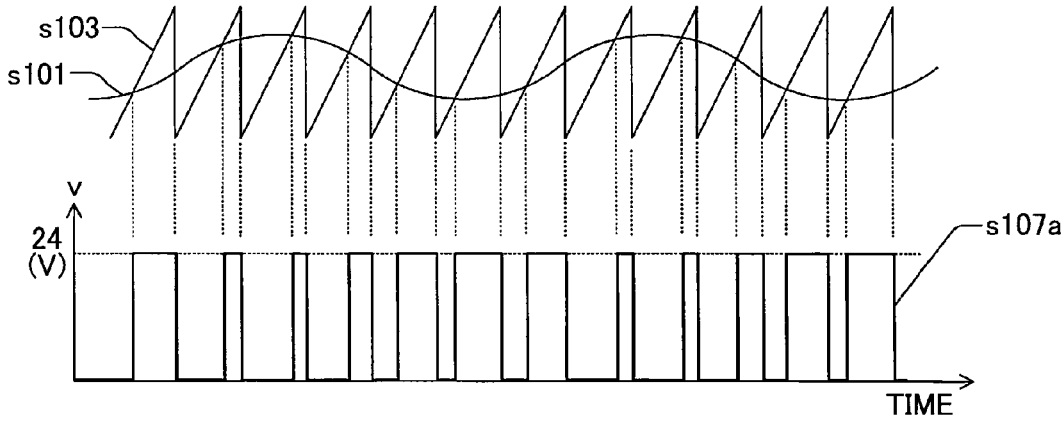
FIG. 10 is a voltage waveform diagram for describing signals output from an IC 1 shown in FIG. 9.
Figure 11:
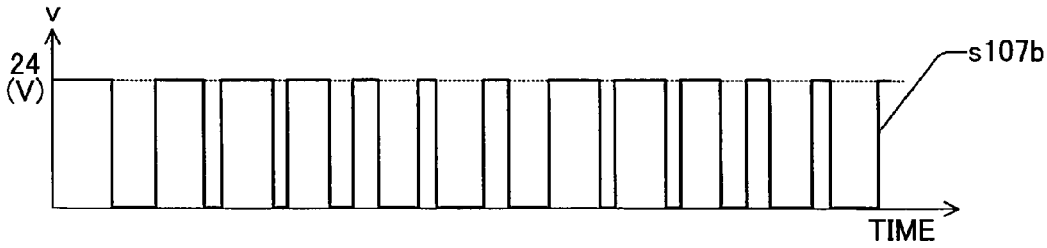
FIG. 11 is a voltage waveform diagram for describing signals output from an IC 2 shown in FIG. 9.

The comparison circuit 107 compares a sinusoidal wave signal output from the sinusoidal wave signal generating circuit 101 and received via the control circuit 105 with a triangular wave signal output from the triangular wave signal generating circuit 103, and outputs the comparison results. As shown in the example of FIG. 9, the comparison circuit 107 includes plural resistors (R1 through R6) and plural operational amplifiers (IC1 and IC2). Furthermore, two signals are output from the comparison circuit 107 (signal s107*a*, signal s107*b*). FIG. 10 illustrates an example of a voltage waveform of signals s107*a*, and FIG. 11 illustrates an example of a voltage waveform of signals s107*b*. The voltage waveform of the signals s107*b* corresponds to an inverted version of the voltage waveform of the signals s107*a*.

Figure 12:
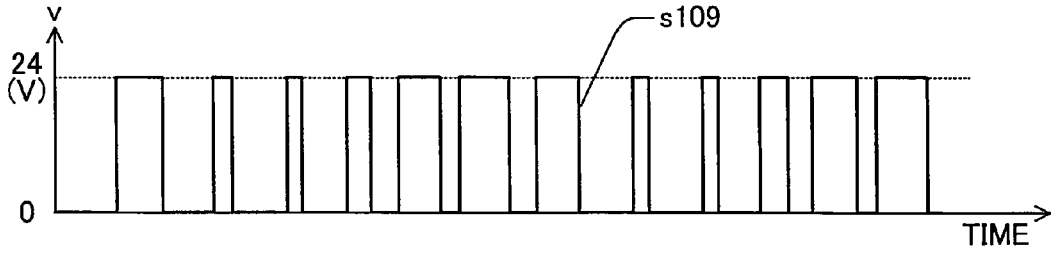
FIG. 12 is a voltage waveform diagram for describing signals output from a switching amplifier circuit shown in FIG. 9.

The switching amplifier circuit 109 performs a switching operation according to signals output from the comparison circuit 107 (in this case, the two signals s107*a* and s107*b*) to amplify the current to an extent at which the AC transformer 113 can be driven. As shown in the example of FIG. 9, the switching amplifier circuit 109 includes plural resistors (R7 through R18), plural transistors (Q1 through Q7), and plural diodes (D1, D2). FIG. 12 illustrates an example of a voltage waveform of signals s109 output from the switching amplifier circuit 109. As can be seen in this voltage waveform, the signals s109 output from the switching amplifier circuit 109 have a pulse form in which the low level is 0 V, i.e., "signals that have been full-switched (full-switch signals)". That is, the switching amplifier circuit 109 performs a full-switching operation to perform the switching.

Figure 13:
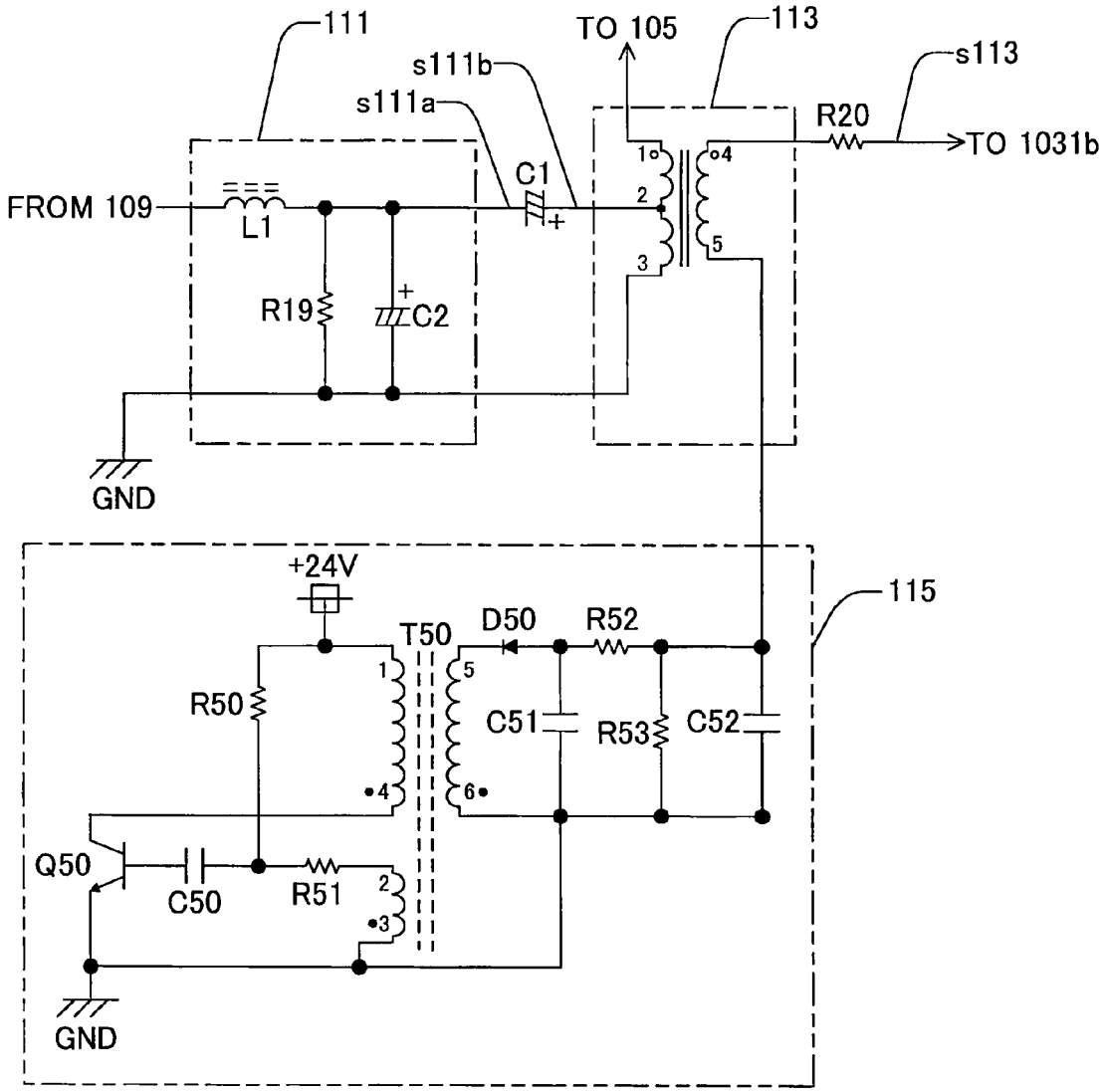
FIG. 13 is a circuit diagram of an LPF, an AC transformer, and a DC bias circuit shown in FIG. 4.
Figure 14:
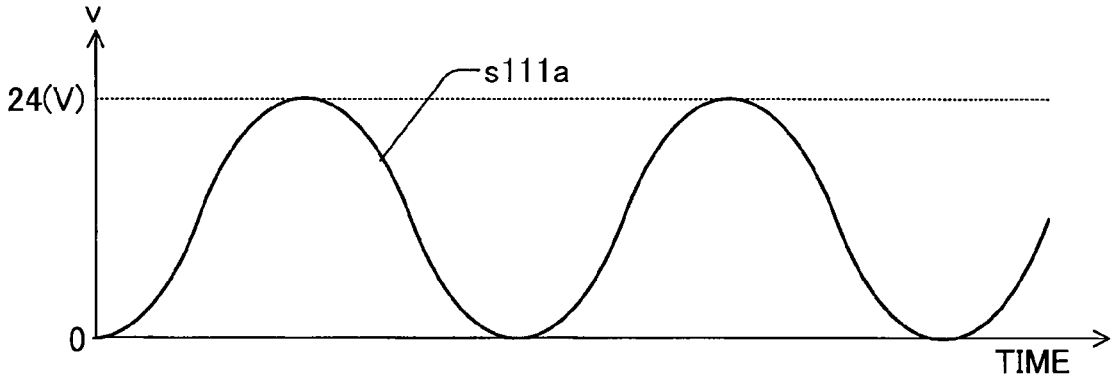
FIG. 14 is a voltage waveform diagram for describing signals output from the LPF shown in FIG. 13.

The low-pass filter (LPF) 111 converts the waveform of a signal output from the switching amplifier circuit 109 into a sinusoidal waveform. As shown in the example of FIG. 13, the low-pass filter (LPF) 111 includes a resistor R19, a coil L1, and a capacitor C2. FIG. 14 illustrates an example of a voltage waveform of signals s111*a* output from the low-pass filter (LPF) 111.

Figure 15:
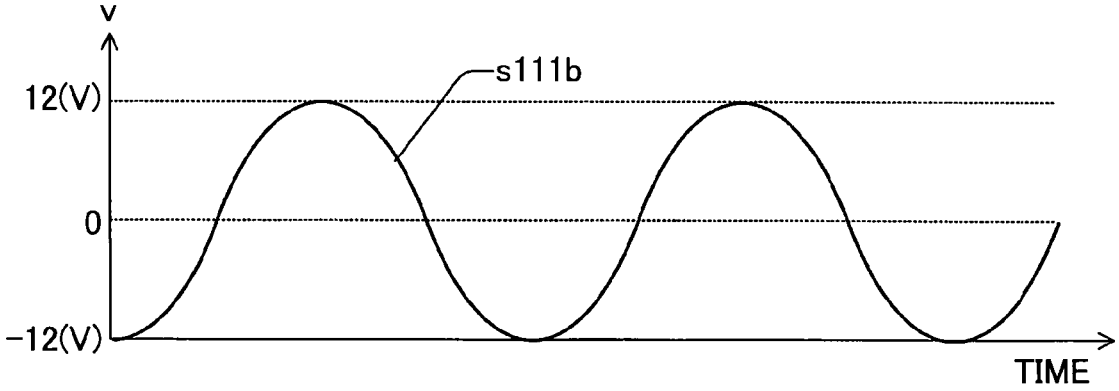
FIG. 15 is a voltage waveform diagram for describing signals received via a capacitor C1 shown in FIG. 13.

The signals s111*a* output from the low-pass filter (LPF) 111 are provided to the AC transformer 113 via a capacitor C1. That is, signals s111*b* output from the capacitor C1 become signals for driving the AC transformer 113. FIG. 15 illustrates an example of a voltage waveform of the signals s111*b* output from the capacitor C1.

Figure 16:
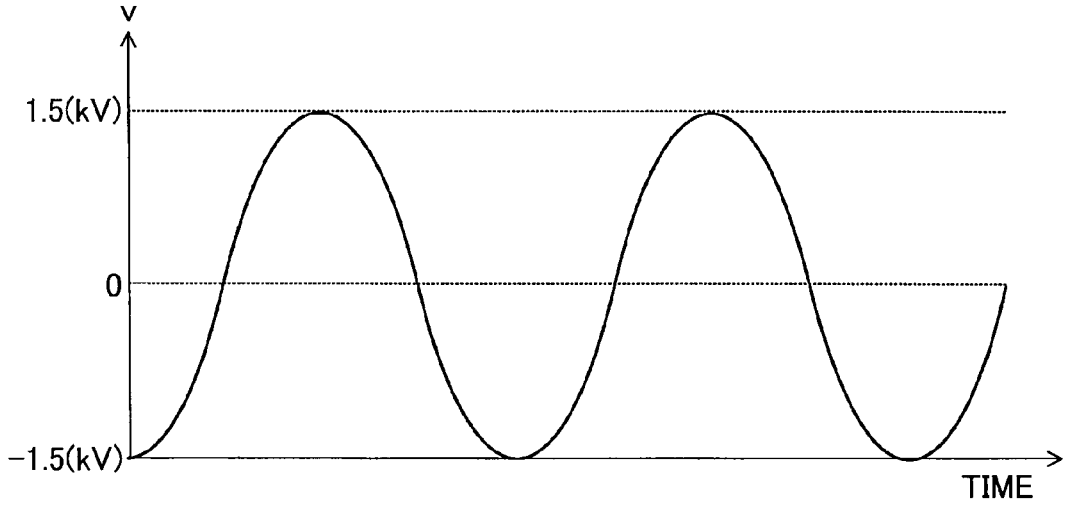
FIG. 16 is a voltage waveform diagram for describing the boosting operation performed by the AC transformer shown in FIG. 13.

The AC transformer 113 boosts the signals s111*b*. As shown in the example of FIG. 16, the signals s111*b* are boosted to ±1.5 kV. The signals including information on the current flowing on the primary side of the AC transformer 113 are fed back to the control circuit 105 as monitoring signals (see FIG. 13).

The control circuit 105 includes a level adjusting circuit 105*a* and a feedback circuit 105*b* (see FIG. 4). The above monitoring signals are input to the feedback circuit 105*b* from the AC transformer 113. In response to signals output from the feedback circuit 105*b*, the level adjusting circuit 105*a* adjusts the peak level in the waveform of the sinusoidal wave signals s101 from the sinusoidal wave signal generating circuit 101, so that the peak level in the waveform of the signals output from the AC transformer 113 becomes a desired level.

The feedback circuit 105*b* includes, for example, a current detecting resistor (not shown) for detecting the current value of the monitoring signal and converting it into voltage information, and a half-wave rectifying circuit (not shown) for half-wave rectifying signals output from the current detecting resistor and outputting a peak value (effective value) (for example, see patent document 1 (Japanese Laid-Open Patent Application No. 2001-117325)).

The level adjusting circuit 105*a* includes, for example, a reference voltage signal generating circuit (not shown) for generating a reference voltage signal corresponding to a desired level, an operational amplifier (not shown) for detecting the difference between a signal output from the reference voltage signal generating circuit and a signal output from the half-wave rectifying circuit, and an adjusting circuit (not shown) for adjusting the output signal s101 from the sinusoidal wave signal generating circuit 101 such that the detection result of the operational amplifier becomes zero and outputting the adjusted signal to the comparison circuit 107.

Figure 17:
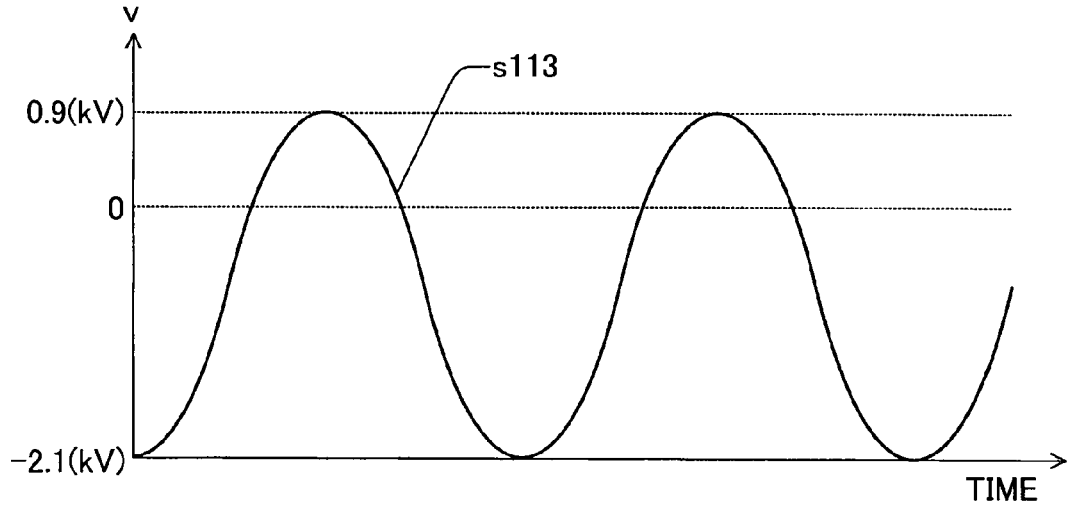
FIG. 17 is a voltage waveform diagram for describing the superposed AC voltage and DC voltage.

The DC bias circuit 115 generates a DC voltage that is to be superposed on a voltage (AC voltage) boosted by the AC transformer 113. As shown in the example of FIG. 13, the DC bias circuit 115 includes plural resistors (R50 through R53), plural capacitors (C50 through C52), a transistor Q50, a diode D50, and a transformer T50. FIG. 17 illustrates an example of a waveform in which the AC voltage and the DC voltage are superposed and a voltage is applied to the charging roller 1031*b* (more precisely the cored bar of the charging roller 1031*b*). In this example, the DC voltage is −600 (V).

As is apparent from the above description, in the charging device 1031 according to the first embodiment, an AC high voltage power supply device is configured with the sinusoidal wave signal generating circuit 101, the triangular wave signal generating circuit 103, the control circuit 105, the comparison circuit 107, the switching amplifier circuit 109, the low-pass filter (LPF) 111, and the AC transformer 113.

Figure 18:
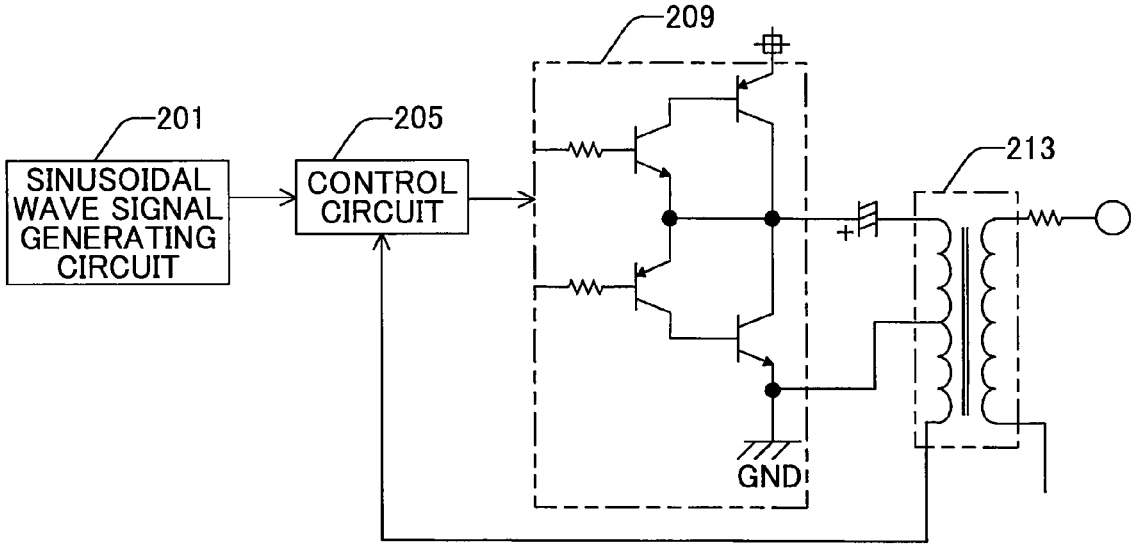
FIG. 18 illustrates a conventional AC high voltage power supply device.
Figure 19:
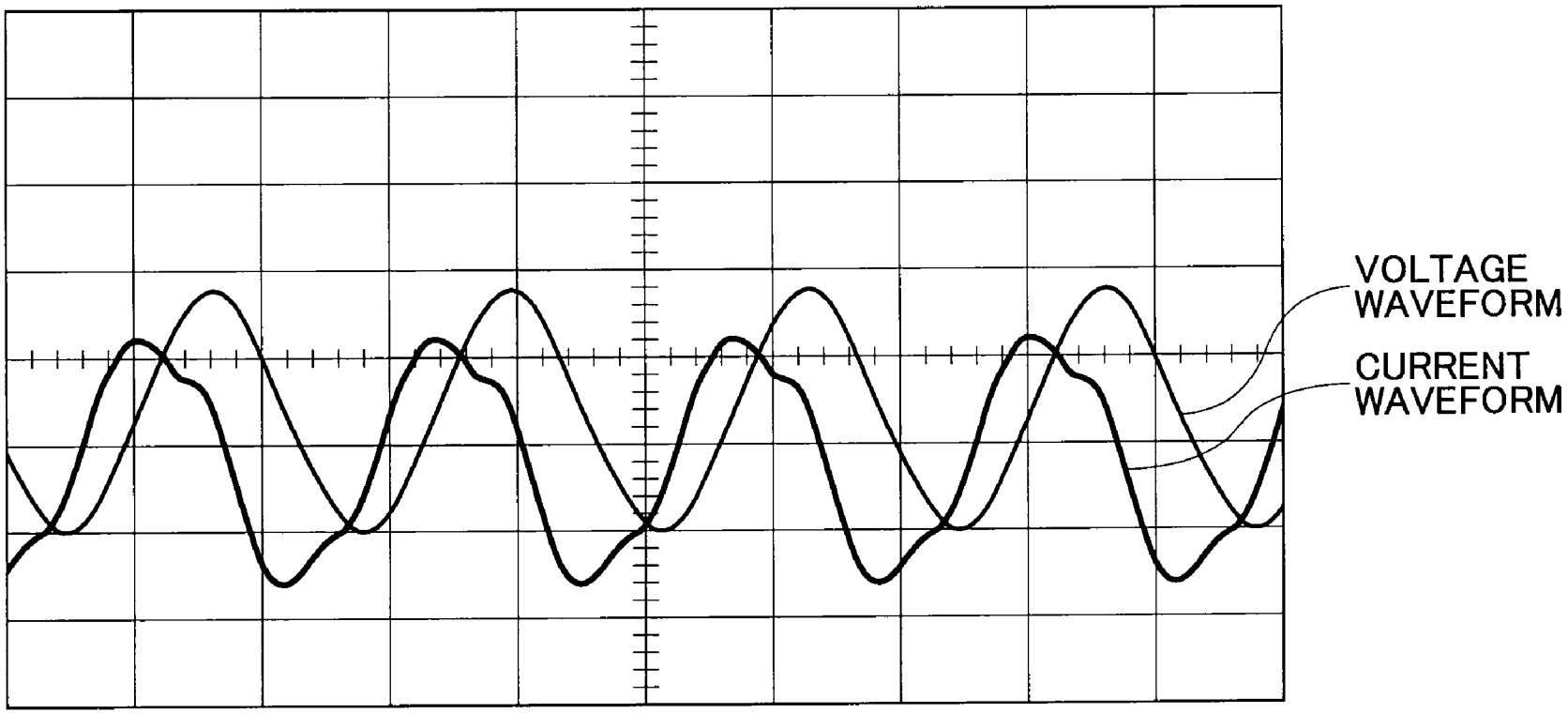
FIG. 19 illustrates the power loss in the device shown in FIG. 18.

As a matter of comparison, FIG. 18 illustrates an example of an AC high voltage power supply device used in a conventional charging device. This AC high voltage power supply device includes a sinusoidal wave signal generating circuit 201, a control circuit 205, an amplifier circuit 209, and an AC transformer 213. As shown in the example of FIG. 19 illustrating signals output from the amplifier circuit 209 in this AC high voltage power supply device, the portion (area) where the current waveform and the voltage waveform overlap each other is large, and the voltage is high when the current flows. Thus, the amounts of heat generation and power loss are large.

Figure 20:
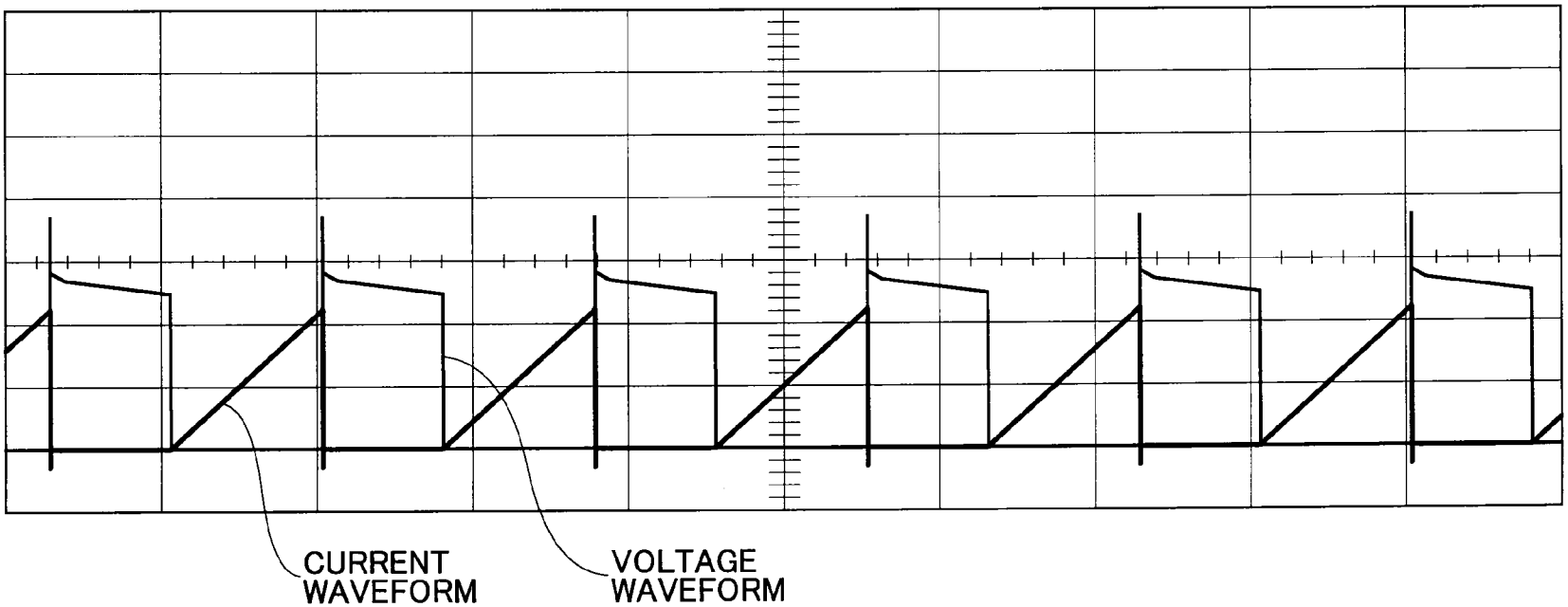
FIG. 20 illustrates effects of the charging device according to an embodiment of the present invention.

Meanwhile, as shown in the example of FIG. 20, in the switching amplifier circuit 109 of the charging device 1031 having the above configuration, the portion (area) where the current waveform and the voltage waveform overlap each other is extremely small, and the voltage is substantially zero when the current flows. Thus, the amounts of heat generation and power loss are extremely small in the switching amplifier circuit 109.

The DC voltage and the AC voltage vary according to the process speed. For example, at a process speed of 30 through 60 cpm, the DC voltage is −450 V through −1500 V, and the AC voltage is approximately 800 V through 2000 V at 800 Hz through 4500 Hz.

"Developing Device"

Next, a description is given of the configuration of the developing device 1032.

The developing device 1032 includes a power supply device 1032*a* (see FIG. 21), a developing roller 1032*b* (see FIG. 1), and a toner cartridge 1032*c* (see FIG. 1).

The toner cartridge 1032*c* stores toner.

Figure 21:
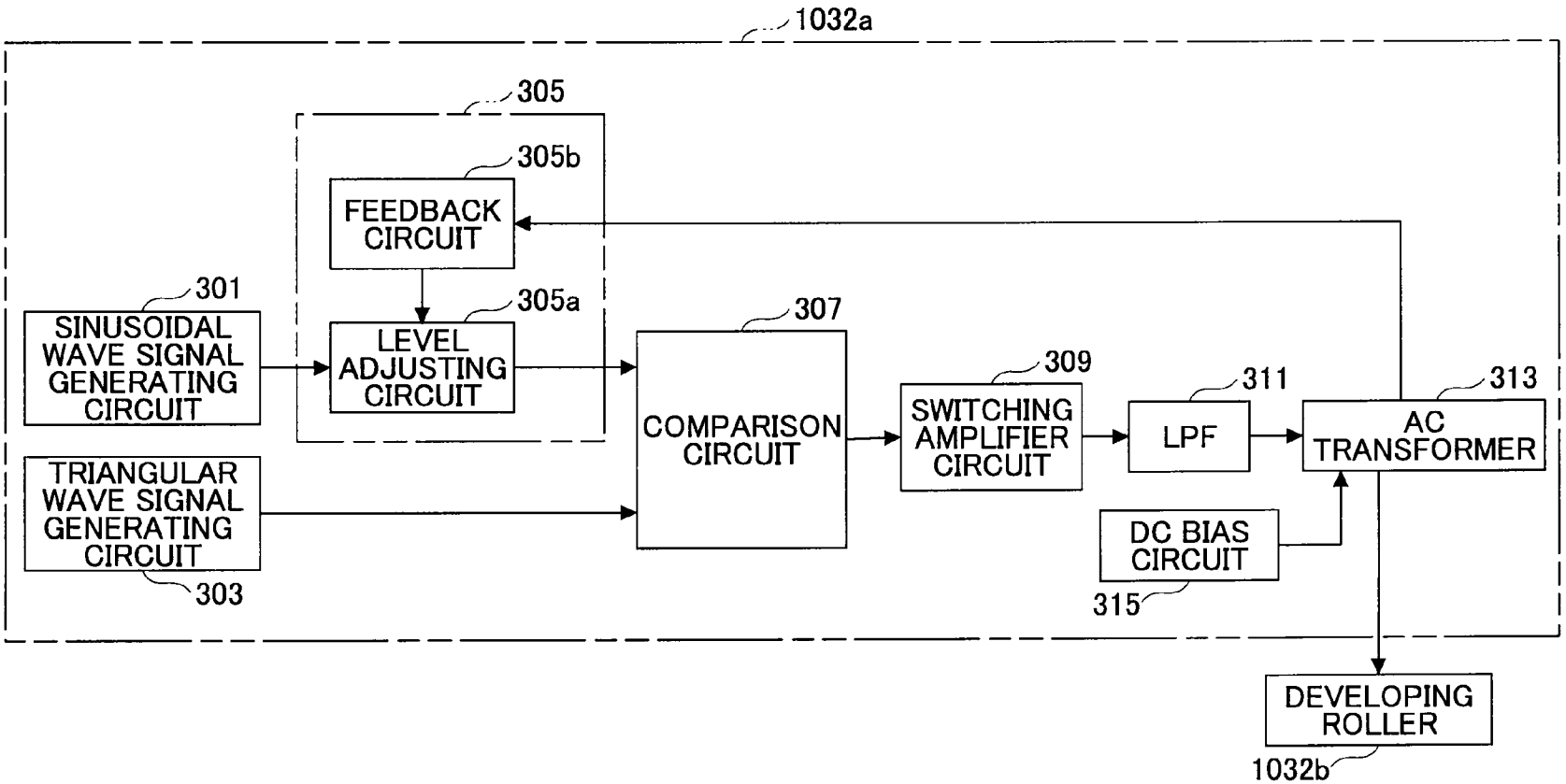
FIG. 21 is a block diagram of a power supply device of a developing device shown in FIG. 1.

As shown in FIG. 21, the power supply device 1032*a* includes a sinusoidal wave signal generating circuit 301, a triangular wave signal generating circuit 303, a control circuit 305, a comparison circuit 307, a switching amplifier circuit 309, a low-pass filter (LPF) 311, an AC transformer 313, and a DC bias circuit 315.

The sinusoidal wave signal generating circuit 301 has the same configuration as that of the sinusoidal wave signal generating circuit 101, and generates sinusoidal wave signals.

The triangular wave signal generating circuit 303 has the same configuration as that of the triangular wave signal generating circuit 103, and generates triangular wave signals.

The comparison circuit 307 has the same configuration as that of the comparison circuit 107, and compares a sinusoidal wave signal output from the sinusoidal wave signal generating circuit 301 and received via the control circuit 305 with a triangular wave signal output from the triangular wave signal generating circuit 303, and outputs the comparison results.

The switching amplifier circuit 309 has the same configuration as that of the switching amplifier circuit 109, and performs a switching operation according to signals output from the comparison circuit 307 to amplify the current to an extent at which the AC transformer 313 can be driven. The signals output from the switching amplifier circuit 309 are full-switch signals. That is, the switching amplifier circuit 309 performs a full-switching operation to perform the switching.

The low-pass filter (LPF) 311 has the same configuration as that of the low-pass filter (LPF) 111, and converts the waveform of signals output from the switching amplifier circuit 309 into a sinusoidal waveform. The signals s111*a* output from the low-pass filter (LPF) 311 are provided to the AC transformer 313 via a capacitor (not shown) similar to the above capacitor C1. That is, signals output from the capacitor (not shown) become signals for driving the AC transformer 313.

Figure 22:
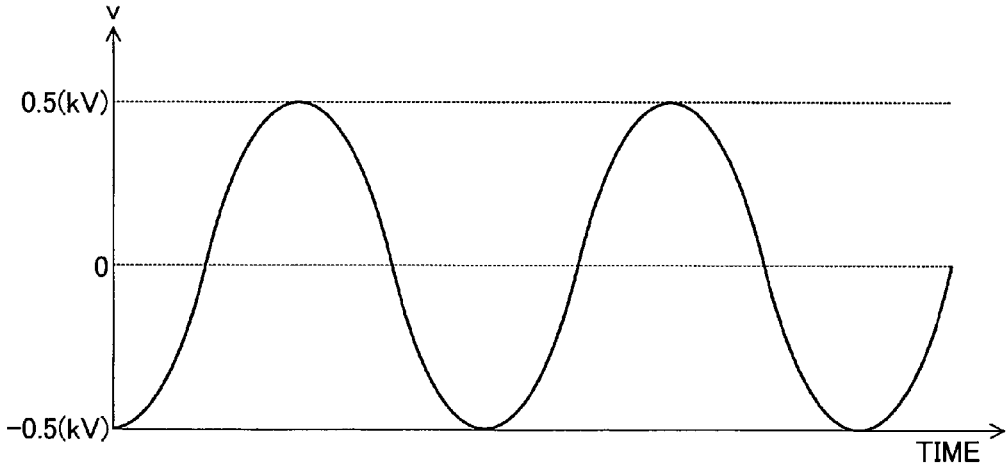
FIG. 22 is a voltage waveform diagram for describing the boosting operation of an AC transformer shown in FIG. 21.

The AC transformer 313 boosts these driving signals. As shown in FIG. 22, the signals are boosted to ±0.5 kV. The signals including information on the current flowing on the primary side of the AC transformer 313 are fed back to the control circuit 305 as monitoring signals.

The control circuit 305 includes a level adjusting circuit 305*a* and a feedback circuit 305*b*. The above monitoring signals are input to the feedback circuit 305*b* from the AC transformer 313. In response to signals output from the feedback circuit 305*b*, the level adjusting circuit 305*a* adjusts the peak level in the waveform of the signals output from the sinusoidal wave signal generating circuit 301, so that the peak level in the waveform of the signals output from the AC transformer 313 becomes a desired level.

Figure 23:
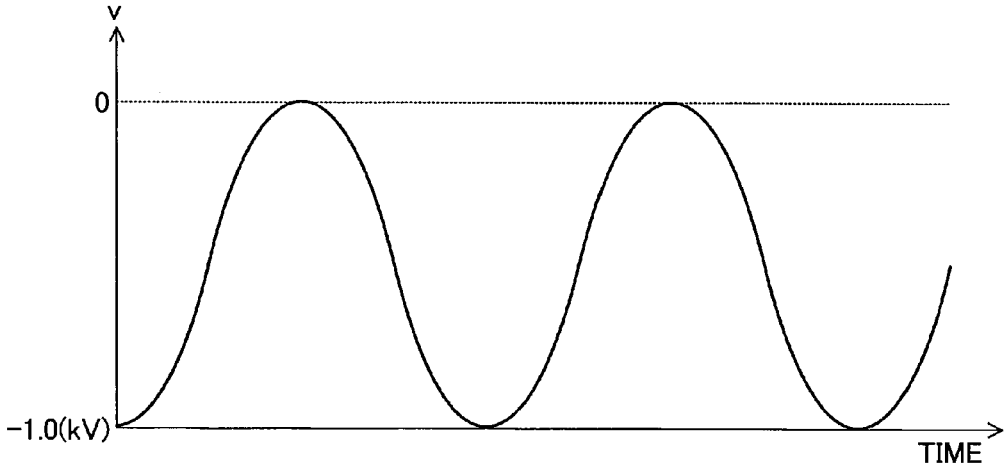
FIG. 23 is a voltage waveform diagram for describing the superposed AC voltage and the DC voltage of the device shown in FIG. 21.

The DC bias circuit 315 has the same configuration as that of the DC bias circuit 115, and generates a DC voltage that is to be superposed on a voltage (AC voltage) boosted by the AC transformer 313. FIG. 23 illustrates an example of a waveform in which the AC voltage and the DC voltage are superposed and a voltage is applied to the developing roller 1032*b*. In this example, the DC voltage is −500 (V).

As is apparent from the above description, in the developing device 1032 according to the first embodiment, an AC high voltage power supply device is configured with the sinusoidal wave signal generating circuit 301, the triangular wave signal generating circuit 303, the control circuit 305, the comparison circuit 307, the switching amplifier circuit 309, the low-pass filter (LPF) 311, and the AC transformer 313.

Similar to the charging device 1031, in the switching amplifier circuit 309 of the developing device 1032 having the above configuration, the voltage is substantially zero when the current flows. Thus, the amounts of heat generation and power loss are extremely small in the switching amplifier circuit 309.

Figure 24:
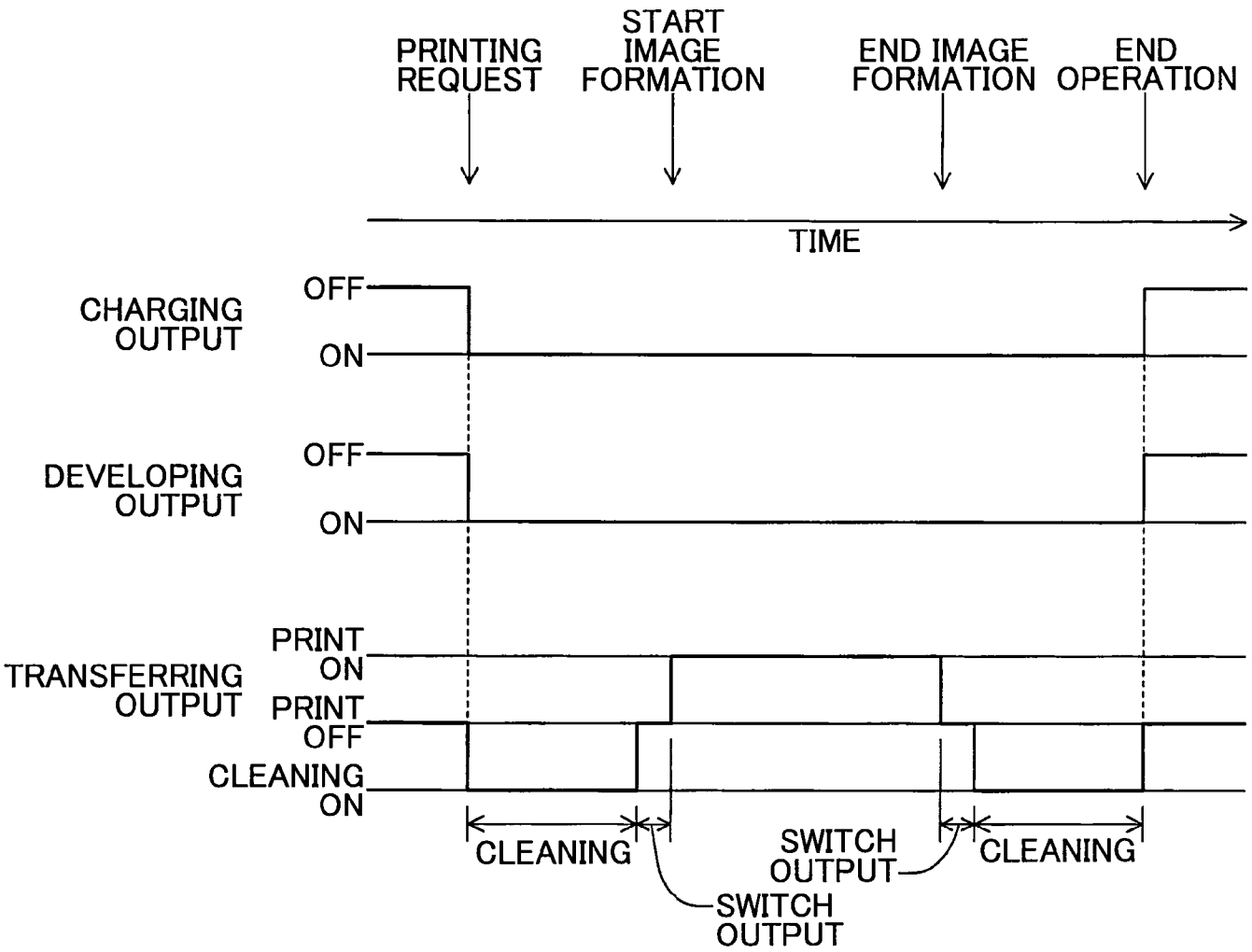
FIG. 24 is a timing chart for describing operations of a printer control device when there is a print request.

As illustrated in FIG. 24, in response to a printing request, the printer control device 1060 controls the charging device 1031, the developing device 1032, and the transfer device 1033. In FIG. 24, at "switch output", the polarity of the power supply is changed. Specifically, for example, when the operation changes from the transfer state to the cleaning state, the power output from "+" is temporarily stopped, and subsequently, the power is output from "−".

As described above, in the power supply device 1031*a* according to the first embodiment, the comparison circuit 107 compares the sinusoidal wave signal with the triangular wave signal, and based on the comparison results, the switching amplifier circuit 109 performs the switching operation. The signals output from the switching amplifier circuit 109 are converted into sinusoidal wave signals by the low-pass filter (LPF) 111, and are then boosted by the AC transformer 113. Furthermore, the sinusoidal wave signals input to the comparison circuit 107 are fed back to the control circuit 105, so that the control circuit 105 can control the peak level of the signals output from the AC transformer 113 to become a desired peak level. In this case, as described above, heat generation in the switching amplifier circuit 109 can be mitigated, and the temperature increase and power loss can be reduced compared to conventional cases. Then, a radiator plate would be unnecessary or could be smaller than those in conventional cases. Accordingly, the size of the device and power consumption can be reduced.

Furthermore, in the power supply device 1032*a* according to the first embodiment, the comparison circuit 307 compares the sinusoidal wave signal with the triangular wave signal, and based on the comparison results, the switching amplifier circuit 309 performs the switching operation. The signals output from the switching amplifier circuit 309 are converted into sinusoidal wave signals by the low-pass filter (LPF) 311, and are then boosted by the AC transformer 313. Furthermore, the sinusoidal wave signals input to the comparison circuit 307 are fed back to the control circuit 305, so that the control circuit 105 can control the peak level of the signals output from the AC transformer 313 to become a desired peak level. In this case, as described above, heat generation in the switching amplifier circuit 309 can be mitigated, and the temperature increase and power loss can be reduced compared to conventional cases. Then, a radiator plate would be unnecessary or could be smaller than those in conventional cases. Accordingly, the size of the device and power consumption can be reduced.

Furthermore, the charging device 1031 according to the first embodiment includes the AC high voltage power supply device with which the temperature increase and power loss can be reduced compared to conventional cases. As a result, the size of the device and power consumption can be reduced.

Furthermore, the developing device 1032 according to the first embodiment includes the AC high voltage power supply device with which the temperature increase and power loss can be reduced compared to conventional cases. As a result, the size of the device and power consumption can be reduced.

Furthermore, the laser printer 1000 according to the first embodiment includes the charging device 1031 and the developing device 1032 with which the size of the device and power consumption can be reduced. As a result, the size of the device and power consumption can be reduced.

In the first embodiment, the signals s109 output from the switching amplifier circuit 109 have a pulse form in which the low level is 0 V; however, the signals are not so limited. As long as the low level is near 0 V, the temperature increase and power loss can be reduced compared to conventional cases. Similarly, as to the signals output from the switching amplifier circuit 309, as long as the low level is near 0 V, the temperature increase and power loss can be reduced compared to conventional cases.

In the first embodiment, when sinusoidal wave signals can be provided from outside, the sinusoidal wave signal generating circuit 101 can be omitted from the charging device 1031. Furthermore, when triangular wave signals can be provided from outside, the triangular wave signal generating circuit 103 can be omitted from the charging device 1031.

Similarly, when sinusoidal wave signals can be provided from outside, the sinusoidal wave signal generating circuit 301 can be omitted from the developing device 1032. Furthermore, when triangular wave signals can be provided from outside, the triangular wave signal generating circuit 303 can be omitted from the developing device 1032.

Figure 25:
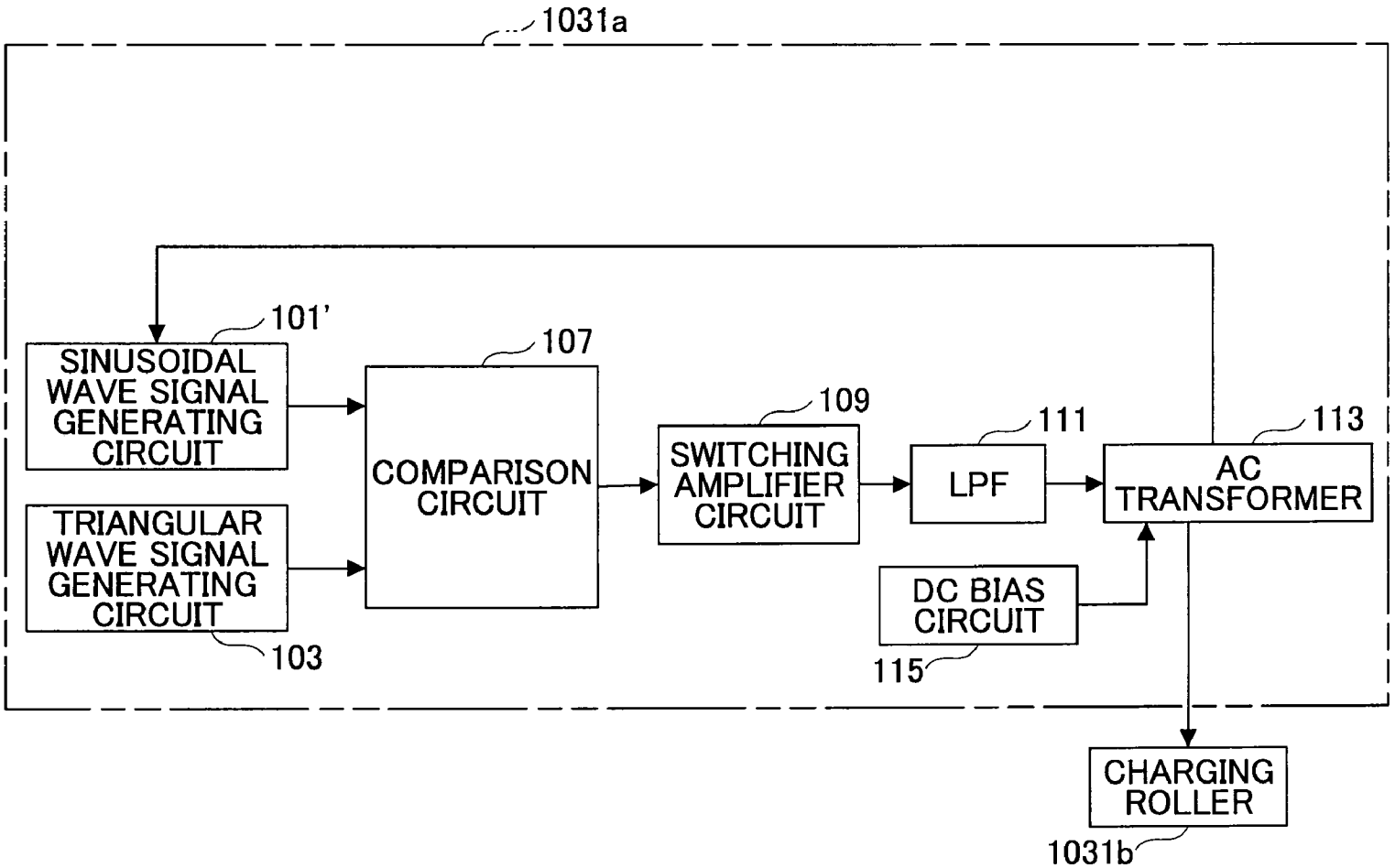
FIG. 25 is a block diagram for describing a modification of the power supply device shown in FIG. 4.

Furthermore, in the first embodiment, the sinusoidal wave signal generating circuit 101 and the control circuit 105 of the charging device 1031 can be combined into a single unit. For example, as shown in the example of FIG. 25, a sinusoidal wave signal generating circuit 101' can be provided instead of the sinusoidal wave signal generating circuit 101 and the control circuit 105. The sinusoidal wave signal generating circuit 101' is for generating sinusoidal wave signals that are adjusted so that the peak level of the voltage waveform of the signals output from the AC transformer 113 becomes a desired level, based on monitoring signals from the AC transformer 113.

Figure 26:
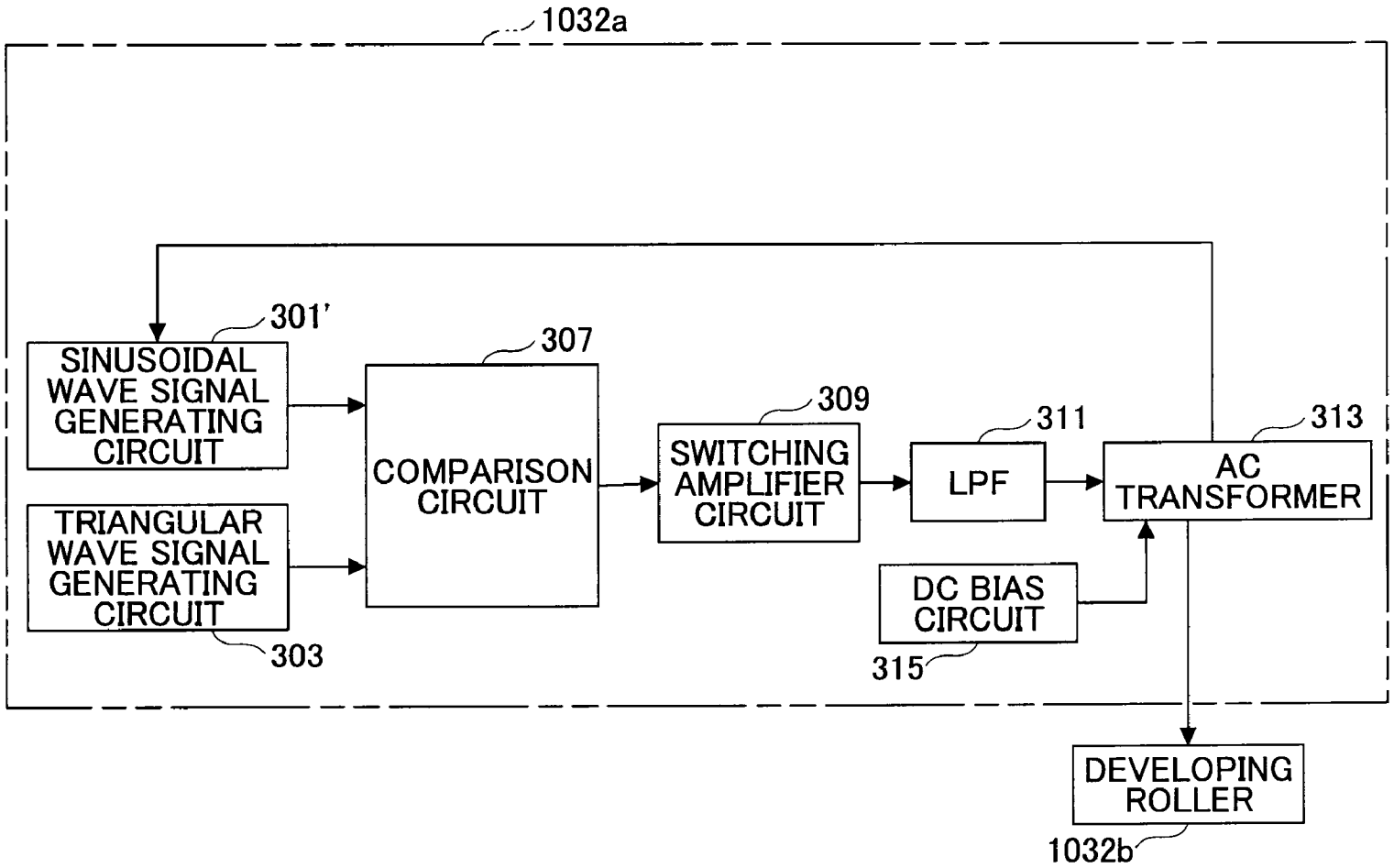
FIG. 26 is a block diagram for describing a modification of the power supply device shown in FIG. 21.

Similarly, the sinusoidal wave signal generating circuit 301 and the control circuit 305 of the developing device 1032 can be combined into a single unit. For example, as shown in the example of FIG. 26, a sinusoidal wave signal generating circuit 301' can be provided instead of the sinusoidal wave signal generating circuit 301 and the control circuit 305. The sinusoidal wave signal generating circuit 301' is for generating sinusoidal wave signals that are adjusted so that the peak level of the voltage waveform of the signals output from the AC transformer 313 becomes a desired level, based on monitoring signals from the AC transformer 313.

Furthermore, in the first embodiment, the charging member is a charging roller; however, the charging member is not so limited. For example, the charging member can be a charging brush, a charging film, or a charging blade.

Furthermore, in the first embodiment, the developing member is a developing roller; however, the developing member is not so limited.

Furthermore, in the first embodiment, the laser printer 1000 includes the charging device 1031 and the developing device 1032. However, either one of the charging device or the developing device can be a conventional device. Even so, the size of the device and power consumption can be reduced compared to the conventional technology.

Furthermore, in the first embodiment, the triangular wave signals have a so-called sawtooth-like form; however, the triangular wave signals are not so limited.

Furthermore, in the first embodiment, the signals including information on the current flowing on the primary side of the AC transformer are used as monitoring signals; however, the monitoring signals are not so limited. The signals including information on the current flowing on the secondary side of the AC transformer can be used as the monitoring signals.

Second Embodiment

Figure 27:
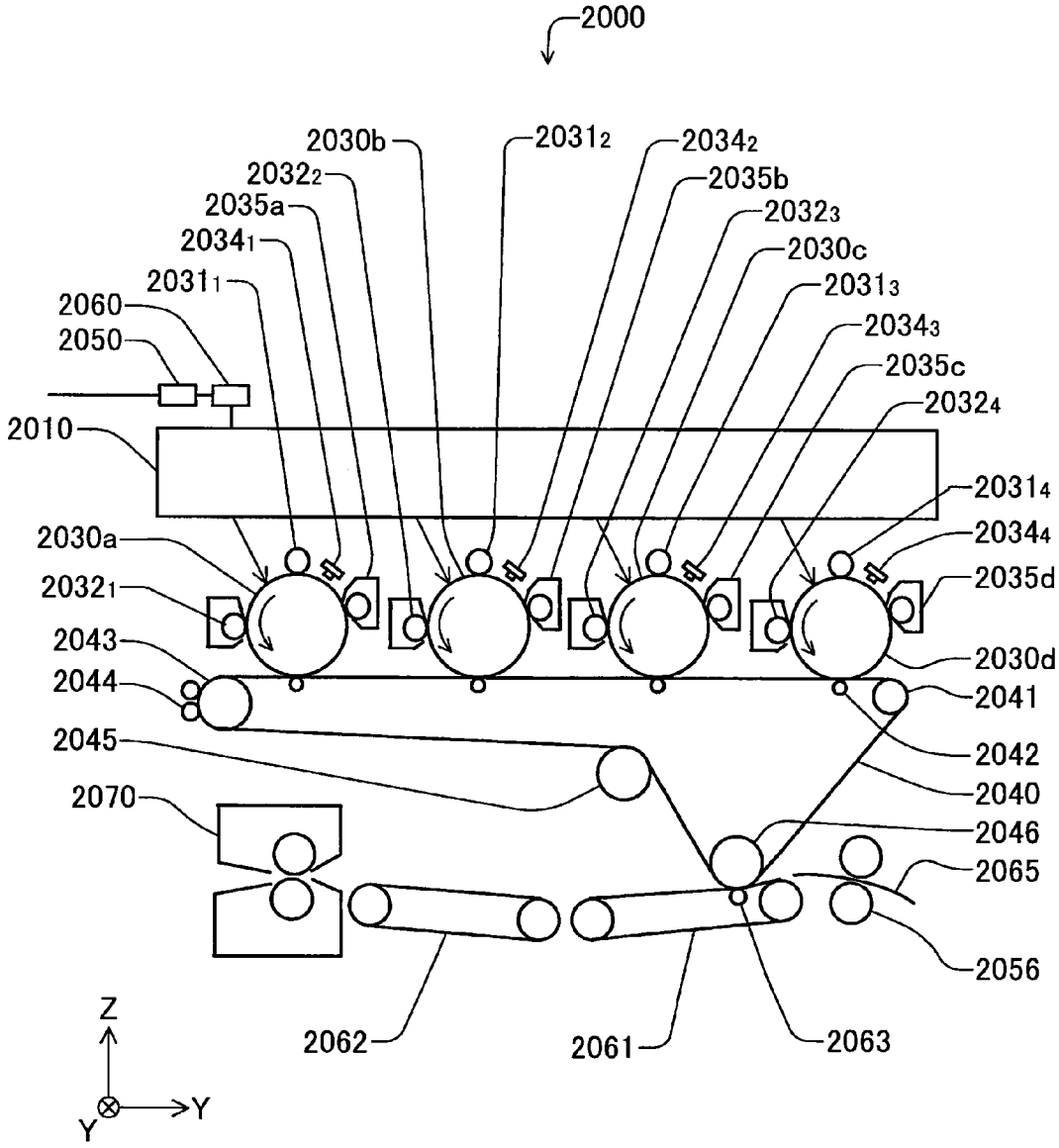
FIG. 27 is a schematic diagram of a color printer according to a second embodiment of the present invention.
Figure 28:
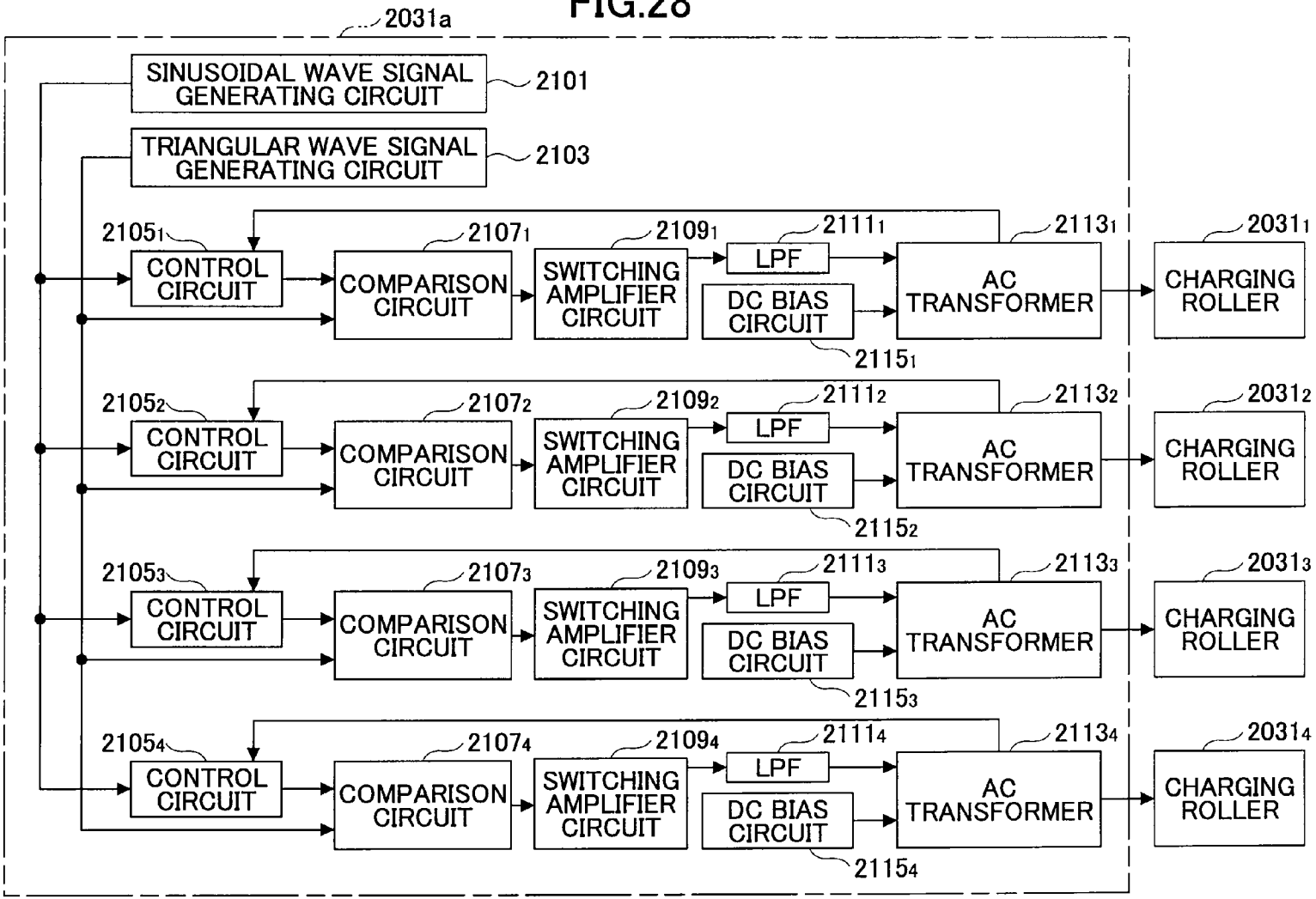
FIG. 28 is a block diagram of a power supply device of a charging device in the color printer.
Figure 29:
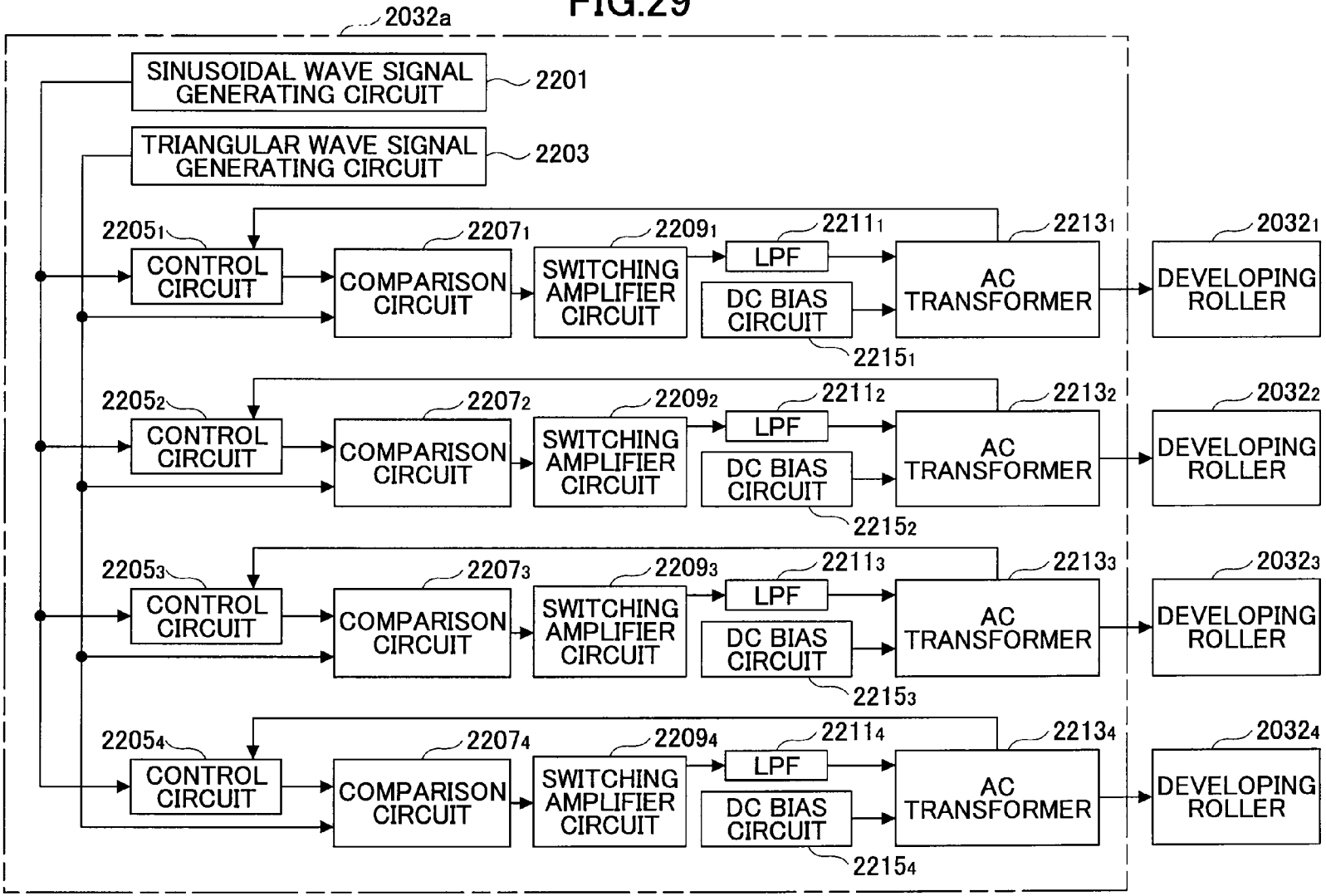
FIG. 29 is a block diagram of a power supply device of a developing device in the color printer.

Next, a description is given of a second embodiment according to the present invention with reference to FIGS. 27 through 29. FIG. 27 is a schematic diagram of a color printer 2000, which is an image forming apparatus according to the second embodiment of the present invention.

The color printer 2000 employs a quadruple tandem method using an intermediate transfer belt, which forms a full-color image by superposing four colors (black, cyan, magenta, and yellow).

The color printer 2000 includes an optical scanning device 2010, four photoconductive drums (2030*a*, 2030*b*, 2030*c*, 2030*d*), a charging device 2031 (not shown), a developing device 2032 (not shown), four cleaning units (2035*a*, 2035*b*, 2035*c*, 2035*d*) each associated with the corresponding photoconductive drum, four discharging lamps ($\mathbf{2034}_1$, $\mathbf{2034}_2$, $\mathbf{2034}_3$, $\mathbf{2034}_4$) each associated with the corresponding photoconductive drum, an intermediate transfer belt 2040, a pair of resist rollers 2056, a transfer belt 2061, a conveying belt 2062, a fixing unit 2070, a communication control device 2050, and a printer control device 2060 which controls all of these units. The photoconductive drums are configured to rotate in directions indicated by arrows in FIG. 27.

"Charging Device"

The charging device 2031 includes a power supply device 2031*a* (see FIG. 28) and four charging rollers ($\mathbf{2031}_1$, $\mathbf{2031}_2$, $\mathbf{2031}_3$, $\mathbf{2031}_4$) (see FIG. 27) each associated with the corresponding photoconductive drum.

As shown in FIG. 28, the power supply device 2031*a* includes a sinusoidal wave signal generating circuit 2101, a triangular wave signal generating circuit 2103, four control circuits ($\mathbf{2105}_1$, $\mathbf{2105}_2$, $\mathbf{2105}_3$, $\mathbf{2105}_4$), four comparison circuits ($\mathbf{2107}_1$, $\mathbf{2107}_2$, $\mathbf{2107}_3$, $\mathbf{2107}_4$), four switching amplifier circuits ($\mathbf{2109}_1$, $\mathbf{2109}_2$, $\mathbf{2109}_3$, $\mathbf{2109}_4$), four low-pass filters (LPF) ($\mathbf{2111}_1$, $\mathbf{2111}_2$, $\mathbf{2111}_3$, $\mathbf{2111}_4$), four AC transformers ($\mathbf{2113}_1$, $\mathbf{2113}_2$, $\mathbf{2113}_3$, $\mathbf{2113}_4$), and four DC bias circuits ($\mathbf{2115}_1$, $\mathbf{2115}_2$, $\mathbf{2115}_3$, $\mathbf{2115}_4$).

The control circuit $\mathbf{2105}_1$, the comparison circuit $\mathbf{2107}_1$, the switching amplifier circuit $\mathbf{2109}_1$, the low-pass filter (LPF) $\mathbf{2111}_1$, the AC transformer $\mathbf{2113}_1$, the DC bias circuit $\mathbf{2115}_1$, and the charging roller $\mathbf{2031}_1$ correspond to the photoconductive drum 2030*a*.

The control circuit $\mathbf{2105}_2$, the comparison circuit $\mathbf{2107}_2$, the switching amplifier circuit $\mathbf{2109}_2$, the low-pass filter (LPF) $\mathbf{2111}_2$, the AC transformer $\mathbf{2113}_2$, the DC bias circuit $\mathbf{2115}_2$, and the charging roller $\mathbf{2031}_2$ correspond to the photoconductive drum 2030*b*.

The control circuit $\mathbf{2105}_3$, the comparison circuit $\mathbf{2107}_3$, the switching amplifier circuit $\mathbf{2109}_3$, the low-pass filter (LPF) $\mathbf{2111}_3$, the AC transformer $\mathbf{2113}_3$, the DC bias circuit $\mathbf{2115}_3$, and the charging roller $\mathbf{2031}_3$ correspond to the photoconductive drum 2030*c*.

The control circuit $\mathbf{2105}_4$, the comparison circuit $\mathbf{2107}_4$, the switching amplifier circuit $\mathbf{2109}_4$, the low-pass filter (LPF) 2111$_4$, the AC transformer 2113$_4$, the DC bias circuit 2115$_4$, and the charging roller 2031$_4$ correspond to the photoconductive drum 2030*d*.

The sinusoidal wave signal generating circuit 2101 has the same configuration as that of the sinusoidal wave signal generating circuit 101 according to the first embodiment, and generates sinusoidal wave signals. The generated sinusoidal wave signals are provided to the control circuits (2105$_1$ through 2105$_4$).

The triangular wave signal generating circuit 2103 has the same configuration as that of the triangular wave signal generating circuit 103 according to the first embodiment, and generates triangular wave signals. The generated triangular wave signals are provided to the control circuits (2107$_1$ through 2107$_4$).

Each of the comparison circuits (2107$_1$ through 2107$_4$) has the same configuration as that of the comparison circuit 107 according to the first embodiment, and compares a sinusoidal wave signal output from the sinusoidal wave signal generating circuit 2101 and received via the corresponding control circuit with a triangular wave signal output from the triangular wave signal generating circuit 2103, and outputs the comparison results.

Each of the switching amplifier circuits (2109$_1$ through 2109$_4$) has the same configuration as that of the switching amplifier circuit 109 according to the first embodiment, and performs a switching operation according to signals output from the corresponding comparison circuit to amplify the current to an extent at which the corresponding AC transformer can be driven. The signals output from each of the switching amplifier circuits (2109$_1$ through 2109$_4$) are full-switch signals. That is, each of the switching amplifier circuits (2109$_1$ through 2109$_4$) performs a full-switching operation to perform the switching.

Each of the low-pass filters (LPF) (2111$_1$ through 2111$_4$) has the same configuration as that of the low-pass filter (LPF) 111 according to the first embodiment, and converts the waveform of signals output from the corresponding switching amplifier circuit into a sinusoidal waveform. The signals output from the each of the low-pass filters (LPF) (2111$_1$ through 2111$_4$) are provided to the corresponding AC transformer via a capacitor (not shown) similar to the capacitor C1 according to the first embodiment.

Each of the AC transformers (2113$_1$ through 2113$_4$) boosts the input signals. The signals including information on the current flowing on the primary side of each of the AC transformers (2113$_1$ through 2113$_4$) are fed back to the corresponding control circuit as monitoring signals.

Each of the control circuits (2105$_1$ through 2105$_4$) has the same configuration as the control circuit 105 according to the first embodiment, and in response to monitoring signals from the corresponding AC transformer, each control circuit (2105$_1$ through 2105$_4$) adjusts the peak level in the waveform of the signals output from the sinusoidal wave signal generating circuit 2101, so that the peak level in the waveform of the signals output from the corresponding AC transformer becomes a desired level.

Each of the DC bias circuits (2115$_1$ through 2115$_4$) has the same configuration as that of the DC bias circuit 115 according to the first embodiment, and generates a DC voltage that is to be superposed on a voltage (AC voltage) boosted by the corresponding AC transformer. The voltage in which the AC voltage and the DC voltage are superposed is applied to the corresponding charging roller.

As is apparent from the above description, in the charging device 2031 according to the second embodiment, an AC high voltage power supply device is configured with the sinusoidal wave signal generating circuit 2101, the triangular wave signal generating circuit 2103, the four control circuits (2105$_1$ through 2105$_4$), the four comparison circuits (2107$_1$ through 2107$_4$), the four switching amplifier circuits (2109$_1$ through 2109$_4$), the four low-pass filters (LPF) (2111$_1$ through 2111$_4$), and the four AC transformers (2113$_1$ through 2113$_4$).

The charging device 2031 charges the photoconductive drum 2030*a* with the charging roller 2031$_1$, charges the photoconductive drum 2030*b* with the charging roller 2031$_2$, charges the photoconductive drum 2030*c* with the charging roller 2031$_3$, and charges the photoconductive drum 2030*d* with the charging roller 2031$_4$.

The optical scanning device 2010 optically scans the charged photoconductive drum 2030*a* based on yellow image information, optically scans the charged photoconductive drum 2030*b* based on magenta image information, optically scans the charged photoconductive drum 2030*c* based on cyan image information, and optically scans the charged photoconductive drum 2030*d* based on black image information.

"Developing Device"

The developing device 2032 includes a power supply device 2032*a* (not shown in FIG. 27, see FIG. 29), four developing rollers (2032$_1$, 2032$_2$, 2032$_3$, 2032$_4$) each associated with the corresponding photoconductive drum, and four toner cartridges (2234$_1$, 2234$_2$, 2234$_3$, 2234$_4$, not shown) each associated with the corresponding developing roller.

The toner cartridge 2234$_1$ stores yellow toner. The toner cartridge 2234$_2$ stores magenta toner. The toner cartridge 2234$_3$ stores cyan toner. The toner cartridge 2234$_4$ stores black toner.

As shown in FIG. 29, the power supply device 2032*a* includes a sinusoidal wave signal generating circuit 2201, a triangular wave signal generating circuit 2203, four control circuits (2205$_1$, 2205$_2$, 2205$_3$, 2205$_4$), four comparison circuits (2207$_1$, 2207$_2$, 2207$_3$, 2207$_4$), four switching amplifier circuits (2209$_1$, 2209$_2$, 2209$_3$, 2209$_4$), four low-pass filters (LPF) (2211$_1$, 2211$_2$, 2211$_3$, 2211$_4$), four AC transformers (2213$_1$, 2213$_2$, 2213$_3$, 2213$_4$), and four DC bias circuits (2215$_1$, 2215$_2$, 2215$_3$, 2215$_4$).

The control circuit 2205$_1$, the comparison circuit 2207$_1$, the switching amplifier circuit 2209$_1$, the low-pass filter (LPF) 2211$_1$, the AC transformer 2213$_1$, the DC bias circuit 2215$_1$, the developing roller 2032$_1$, and the toner cartridge 2234$_1$ correspond to the photoconductive drum 2030*a*.

The control circuit 2205$_2$, the comparison circuit 2207$_2$, the switching amplifier circuit 2209$_2$, the low-pass filter (LPF) 2211$_2$, the AC transformer 2213$_2$, the DC bias circuit 2215$_2$, the developing roller 2032$_2$, and the toner cartridge 2234$_2$ correspond to the photoconductive drum 2030*b*.

The control circuit 2205$_3$, the comparison circuit 2207$_3$, the switching amplifier circuit 2209$_3$, the low-pass filter (LPF) 2211$_3$, the AC transformer 2213$_3$, the DC bias circuit 2215$_3$, the developing roller 2032$_3$, and the toner cartridge 2234$_3$ correspond to the photoconductive drum 2030*c*.

The control circuit 2205$_4$, the comparison circuit 2207$_4$, the switching amplifier circuit 2209$_4$, the low-pass filter (LPF) 2211$_4$, the AC transformer 2213$_4$, the DC bias circuit 2215$_4$, the developing roller 2032$_4$, and the toner cartridge 2234$_4$ correspond to the photoconductive drum 2030*d*.

The sinusoidal wave signal generating circuit 2201 has the same configuration as that of the sinusoidal wave signal generating circuit 301 according to the first embodiment, and generates sinusoidal wave signals. The generated sinusoidal wave signals are provided to the control circuits (2205$_1$ through 2205$_4$).

The triangular wave signal generating circuit 2203 has the same configuration as that of the triangular wave signal generating circuit 303 according to the first embodiment, and generates triangular wave signals. The generated triangular wave signals are provided to the control circuits ($\mathbf{2207}_1$ through $\mathbf{2207}_4$).

Each of the comparison circuits ($\mathbf{2207}_1$ through $\mathbf{2207}_4$) has the same configuration as that of the comparison circuit 307 according to the first embodiment, and compares a sinusoidal wave signal output from the sinusoidal wave signal generating circuit 2201 and received via the corresponding control circuit with a triangular wave signal output from the triangular wave signal generating circuit 2203, and outputs the comparison results.

Each of the switching amplifier circuits ($\mathbf{2209}_1$ through $\mathbf{2209}_4$) has the same configuration as that of the switching amplifier circuit 309 according to the first embodiment, and performs a switching operation according to signals output from the corresponding comparison circuit to amplify the current to an extent at which the corresponding AC transformer can be driven. The signals output from each of the switching amplifier circuits ($\mathbf{2209}_1$ through $\mathbf{2209}_4$) are full-switch signals. That is, each of the switching amplifier circuits ($\mathbf{2209}_1$ through $\mathbf{2209}_4$) performs a full-switching operation to perform the switching.

Each of the low-pass filters (LPF) ($\mathbf{2211}_1$ through $\mathbf{2211}_4$) has the same configuration as that of the low-pass filter (LPF) 311 according to the first embodiment, and converts the waveform of signals output from the corresponding switching amplifier circuit into a sinusoidal waveform. The signals output from the each of the low-pass filters (LPF) ($\mathbf{2211}_1$ through $\mathbf{2211}_4$) are provided to the corresponding AC transformer via a capacitor (not shown) similar to the capacitor C1 according to the first embodiment.

Each of the AC transformers ($\mathbf{2213}_1$ through $\mathbf{2213}_4$) boosts the input signals. The signals including information on the current flowing on the primary side of each of the AC transformers ($\mathbf{2213}_1$ through $\mathbf{2213}_4$) are fed back to the corresponding control circuit as monitoring signals.

Each of the control circuits ($\mathbf{2205}_1$ through $\mathbf{2205}_4$) has the same configuration as the control circuit 305 according to the first embodiment, and in response to monitoring signals from the corresponding AC transformer, each control circuit ($\mathbf{2205}_1$ through $\mathbf{2205}_4$) adjusts the peak level in the waveform of the signals output from the sinusoidal wave signal generating circuit 2201, so that the peak level in the waveform of the signals output from the corresponding AC transformer becomes a desired level.

Each of the DC bias circuits ($\mathbf{2215}_1$ through $\mathbf{2215}_4$) has the same configuration as that of the DC bias circuit 315 according to the first embodiment, and generates a DC voltage that is to be superposed on an AC voltage boosted by the corresponding AC transformer. The voltage in which the AC voltage and the DC voltage are superposed is applied to the corresponding developing roller.

As is apparent from the above description, in the developing device 2032 according to the second embodiment, an AC high voltage power supply device is configured with the sinusoidal wave signal generating circuit 2201, the triangular wave signal generating circuit 2203, the four control circuits ($\mathbf{2205}_1$ through $\mathbf{2205}_4$), the four comparison circuits ($\mathbf{2207}_1$ through $\mathbf{2207}_4$), the four switching amplifier circuits ($\mathbf{2209}_1$ through $\mathbf{2209}_4$), the four low-pass filters (LPF) ($\mathbf{2211}_1$ through $\mathbf{2211}_4$), and the four AC transformers ($\mathbf{2213}_1$ through $\mathbf{2213}_4$).

The developing device 2032 develops the electrostatic latent image formed on the photoconductive drum 2030*a* with yellow toner, develops the electrostatic latent image formed on the photoconductive drum 2030*b* with magenta toner, develops the electrostatic latent image formed on the photoconductive drum 2030*c* with cyan toner, and develops the electrostatic latent image formed on the photoconductive drum 2030*d* with black toner.

The toner images of the four photoconductive drums are transferred and superposed onto the intermediate transfer belt 2040, and the superposed toner image is then transferred onto a print sheet 2065 that is supplied onto the transfer belt 2061 via the pair of resist rollers 2056. The print sheet 2065 is conveyed by the conveying belt 2062 to the fixing unit 2070, where the toner image transferred onto the print sheet 2065 is fixed.

Each of the cleaning units (2035*a* through 2035*d*) removes toner (residual toner) remaining on the surface of the corresponding photoconductive drum.

Each of the discharging lamps ($\mathbf{2034}_1$ through $\mathbf{2034}_4$) discharges the surface of the corresponding photoconductive drum.

In FIG. 27, 2041 denotes a following roller, 2042 denotes a bias roller, 2043 denotes a driving roller, 2044 denotes a fur brush, 2045 denotes a tension roller, 2046 denotes a transfer opposite roller, and 2063 denotes a sheet transfer bias roller.

As described above, the power supply device 2031*a* according to the second embodiment is the same as having plural power supply devices 1031*a* according to the first embodiment, corresponding to the number of photoconductive drums. Thus, the same effects as those of the power supply device 1031*a* according to the first embodiment can be achieved. Moreover, in this case, components of the same kind can be combined into a single chip, and therefore costs can be reduced even further.

Furthermore, the charging device 2031 according to the second embodiment is substantially the same as having plural charging devices 1031 according to the first embodiment, corresponding to the number of photoconductive drums. Thus, the same effects as those of the charging device 1031 according to the first embodiment can be achieved.

Furthermore, the developing device 2032 according to the second embodiment is substantially the same as having plural developing devices 1032 according to the first embodiment, corresponding to the number of photoconductive drums. Thus, the same effects as those of the developing device 1032 according to the first embodiment can be achieved.

The color printer 2000 according to the second embodiment includes the charging device 2031 and the developing device 2032. As a result, the same effects as those of the laser printer 1000 according to the first embodiment can be achieved.

In the second embodiment, one optical scanning device can be provided for each color or for every two colors.

Furthermore, in the second embodiment, when sinusoidal wave signals can be provided from outside, the sinusoidal wave signal generating circuit 2101 can be omitted from the charging device 2031. Furthermore, when triangular wave signals can be provided from outside, the triangular wave signal generating circuit 2103 can be omitted from the charging device 2031.

Similarly, when sinusoidal wave signals can be provided from outside, the sinusoidal wave signal generating circuit 2201 can be omitted from the developing device 2032. Furthermore, when triangular wave signals can be provided from outside, the triangular wave signal generating circuit 2203 can be omitted from the developing device 2032.

Furthermore, in the second embodiment, the laser printer 2000 includes the charging device 2031 and the developing device 2032. However, either one of the charging device or the developing device can be a conventional device. Even so, the size of the device and power consumption can be reduced compared to the conventional technology.

As described above, the AC high voltage power supply device according to an embodiment of the present invention is applicable for the purpose of reducing the size of the device and power consumption. The charging device and the developing device according to an embodiment of the present invention are applicable for the purpose of reducing the size of the device and power consumption. The image forming apparatus according to an embodiment of the present invention is applicable for the purpose of reducing the size of the device and power consumption.

According to a first aspect of the present invention, there is provided an AC high voltage power supply device including a comparison circuit configured to compare a first signal of a sinusoidal waveform and a second signal of a triangular waveform, and to output a comparison result signal corresponding to results of the comparison; a switching amplifier circuit configured to perform a switching operation based on the comparison result signal output from the comparison circuit to perform signal amplification, and to output a switch signal; a conversion circuit configured to convert a waveform of the switch signal output from the switching amplifier circuit into a sinusoidal waveform, and to output a converted signal; a transformer configured to boost a voltage of the converted signal output from the conversion circuit; and a control circuit configured to perform feedback control on the first signal input to the comparison circuit based on a monitoring signal including an input signal or an output signal of the transformer, so that a peak level of the output signal of the transformer becomes a desired peak level.

Accordingly, a comparison circuit compares a first signal of a sinusoidal waveform and a second signal of a triangular waveform, and based on the comparison results, a switching amplifier circuit performs a switching operation and signal amplification. A conversion circuit converts a waveform of the switch signal output from the switching amplifier circuit into a sinusoidal waveform, and then a transformer boosts the voltage of the converted signal. Furthermore, a control circuit performs feedback control on the first signal input to the comparison circuit so that a peak level of the output signal of the transformer becomes a desired peak level. In this case, in the switching amplifier circuit, the voltage when a current is flowing can be substantially zero, and therefore heat generation in the switching amplifier circuit can be mitigated. As a result, the temperature increase and power loss can be reduced compared to conventional cases. Then, a radiator plate would be unnecessary or could be smaller than those in conventional cases. Accordingly, the size of the device and power consumption can be reduced.

According to a second aspect of the present invention, there is provided a charging device for charging an object, including the AC high voltage power supply device according to an aspect of the present invention; a DC bias circuit configured to generate a DC voltage to be superposed on an AC voltage that has been boosted by the transformer of the AC high voltage power supply device; and a charging member configured to have applied a voltage in which the AC voltage and the DC voltage are superposed and to charge the object.

The AC high voltage power supply device according to an aspect of the present invention is included, and as a result, the size of the device and power consumption can be reduced.

According to a third aspect of the present invention, there is provided a developing device for developing an electrostatic latent image on an object, including toner; the AC high voltage power supply device according to an aspect of the present invention; a DC bias circuit configured to generate a DC voltage to be superposed on an AC voltage that has been boosted by the transformer of the AC high voltage power supply device; and a developing member configured to have applied a voltage in which the AC voltage and the DC voltage are superposed and to cause the toner to adhere to the electrostatic latent image.

The AC high voltage power supply device according to an aspect of the present invention is included, and as a result, the size of the device and power consumption can be reduced.

According to a fourth aspect of the present invention, there is provided a first image forming apparatus including at least one image carrier; at least one of the charging device according to an aspect of the present invention configured to charge a surface of the image carrier; and at least one optical scanning device configured to scan the image carrier charged by the charging device, with a light beam including image information.

According to a fifth aspect of the present invention, there is provided a second image forming apparatus including at least one image carrier; at least one optical scanning device configured to scan the image carrier with a light beam including image information, and to form an electrostatic latent image on a surface of the image carrier; and at least one of the developing device according to an aspect of the present invention, configured to develop the electrostatic latent image.

According to a sixth aspect of the present invention, there is provided an image forming apparatus including at least one image carrier; at least one charging device configured to charge a surface of the image carrier, the charging device including the AC high voltage power supply device according to an aspect of the present invention, a DC bias circuit configured to generate a DC voltage to be superposed on an AC voltage that has been boosted by the transformer of the AC high voltage power supply device, and a charging member configured to have applied a voltage in which the AC voltage and the DC voltage are superposed and to charge the surface of the image carrier; at least one optical scanning device configured to scan the image carrier charged by the charging device, with a light beam including image information, and to form an electrostatic latent image on the surface of the image carrier; and at least one developing device configured to develop the electrostatic latent image, the developing device including toner, the AC high voltage power supply device according to an aspect of the present invention, a DC bias circuit configured to generate a DC voltage to be superposed on an AC voltage that has been boosted by the transformer of the AC high voltage power supply device, and a developing member configured to have applied a voltage in which the AC voltage and the DC voltage are superposed and to cause the toner to adhere to the electrostatic latent image.

Each of the first to third image forming apparatuses described above includes at least one charging device according to an aspect of the present invention and/or at least one developing device according to an aspect of the present invention. As a result, the size of the device and power consumption can be reduced.

The present invention is not limited to the specifically disclosed embodiment, and variations and modifications may be made without departing from the scope of the present invention.

The present application is based on Japanese Priority Patent Application No. 2007-298839, filed on Nov. 19, 2007, the entire contents of which are hereby incorporated herein by reference.

What is claimed is:

1. An AC high voltage power supply device, comprising:

a comparison circuit configured to compare a first sinusoidal waveform signal and a second triangular waveform signal, and to output a comparison result signal corresponding to results of the comparison;

a switching amplifier circuit configured to perform a full switching operation based on the comparison result signal output from the comparison circuit to perform signal amplification, and to output a full switch signal in which a low level is 0V;

a conversion circuit configured to convert a waveform of the switch signal output from the switching amplifier circuit into a sinusoidal waveform, and to output a converted signal;

a transformer configured to boost a voltage of the converted signal output from the conversion circuit; and a control circuit configured to perform feedback control on the first sinusoidal waveform signal based on a monitoring signal at an input or an output of the transformer, so that a peak level of the output signal of the transformer becomes a desired peak level, the control circuit comprising:

a feedback circuit configured to receive the monitoring signal and to output a feedback signal, a level adjusting circuit configured to adjust a peak level of the first sinusoidal waveform signal according to the feedback signal output from the feedback circuit, a current detecting resistor for detecting a current value of the monitoring signal and converting it to voltage information, and a half-wave rectifying circuit for half-wave rectifying signals output from the current detecting resistor and outputting a peak value, wherein the level adjusting circuit includes:

a reference voltage signal generating circuit for generating a reference voltage signal corresponding to a desired level, and an operational amplifier for detecting a difference between a signal output from the reference voltage signal generating circuit and the peak value signal output from the half-wave rectifying circuit.

2. The AC high voltage power supply device according to claim 1, wherein the conversion circuit comprises a low-pass filter.

3. The AC high voltage power supply device according to claim 1, further comprising a first signal generating circuit configured to generate the first sinusoidal waveform signal; and a second signal generating circuit configured to generate the second triangular waveform signal.

4. The AC high voltage power supply device according to claim 3, further comprising plural sets of the comparison circuit, the switching amplifier circuit, the conversion circuit, the transformer, and the control circuit, wherein the first sinusoidal waveform signal and the second triangular waveform signal are input to the comparison circuit in each of the plural sets.

5. A charging device for charging an object, comprising:

the AC high voltage power supply device according to claim 1;

a DC bias circuit configured to generate a DC voltage to be superposed on an AC voltage that has been boosted by the transformer of the AC high voltage power supply device; and a charging member, the output signal of the AC high voltage power supply device and the DC voltage being superposed and applied to charge the charging member.

6. A developing device for developing an electrostatic latent image on an object, comprising:

toner;

the AC high voltage power supply device according to claim 1;

a DC bias circuit configured to generate a DC voltage to be superposed on an AC voltage that has been boosted by the transformer of the AC high voltage power supply device; and a developing member, the output signal of the AC high voltage power supply device and the DC voltage being superposed and applied to cause the toner to adhere to the electrostatic latent image.

7. An image forming apparatus, comprising:

at least one image carrier;

at least one of the charging device according to claim 5 configured to charge a surface of the at least one image carrier; and at least one optical scanning device configured to scan the charged surface of the at least one image carrier with a light beam comprising image information.

8. An image forming apparatus, comprising:

at least one image carrier;

at least one optical scanning device configured to scan the at least one image carrier with a light beam comprising image information and form an electrostatic latent image on a surface of the at least one image carrier; and at least one of the developing device according to claim 6, configured to develop the electrostatic latent image.

9. An image forming apparatus, comprising:

at least one image carrier;

at least one charging device configured to charge a surface of the at least one image carrier, the charging device comprising the AC high voltage power supply device according to claim 1, a DC bias circuit configured to generate a DC voltage to be superposed on an AC voltage that has been boosted by the transformer of the AC high voltage power supply device, and a charging member, the output signal of the AC high voltage power supply device and the DC voltage being superposed and applied to charge the surface of the at least one image carrier;

at least one optical scanning device configured to scan the charged surface of the at least one image carrier with a light beam comprising image information and form an electrostatic latent image on the surface of the at least one image carrier; and at least one developing device configured to develop the electrostatic latent image, the developing device comprising toner, the AC high voltage power supply device according to claim 1, a DC bias circuit configured to generate a DC voltage to be superposed on an AC voltage that has been boosted by the transformer of the AC high voltage power supply device, and a developing member, the output signal of the AC high voltage power supply device and the DC voltage being superposed and applied to cause the toner to adhere to the electrostatic latent image.

10. An image forming apparatus according to claim 7, wherein the image information comprises multicolor image information.

* * * * *